US008960871B2

(12) United States Patent
Karasawa et al.

(10) Patent No.: US 8,960,871 B2
(45) Date of Patent: Feb. 24, 2015

(54) MOUNTING MEMBER, LIQUID CONTAINER WITH MOUNTING MEMBER, AND LIQUID SUPPLY SYSTEM

(71) Applicant: Seiko Epson Corporation, Tokyo (JP)

(72) Inventors: Masahiro Karasawa, Nagano (JP); Yuji Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/736,458

(22) Filed: Jan. 8, 2013

(65) Prior Publication Data

US 2013/0194357 A1 Aug. 1, 2013

(30) Foreign Application Priority Data

Jan. 13, 2012 (JP) ..... 2012-005347
Jan. 25, 2012 (JP) ..... 2012-013238
Feb. 6, 2012 (JP) ..... 2012-022813

(51) Int. Cl.
*B41J 2/175* (2006.01)

(52) U.S. Cl.
CPC ..... *B41J 2/17566* (2013.01); *B41J 2/1752* (2013.01); *B41J 2/17553* (2013.01)
USPC ..... 347/86

(58) Field of Classification Search
CPC ..... B41J 2/1752; B41J 2/17566
USPC ..... 347/86
See application file for complete search history.

(56) References Cited

U.S. PATENT DOCUMENTS 5,896,151 A 4/1999 Miyazawa et al.
6,106,112 A 8/2000 Okubo et al.
6,220,702 B1 4/2001 Nakamura et al.
6,422,674 B1 * 7/2002 Hinami et al. ..... 347/7
6,435,673 B1 8/2002 Hattori et al.
6,591,874 B2 7/2003 Credle, Jr.
6,609,789 B1 8/2003 Hunt
7,241,001 B2 7/2007 Hattori et al.
7,814,656 B2 10/2010 Prasad
7,984,980 B2 * 7/2011 Kachi ..... 347/86
D656,184 S 3/2012 Iwamuro et al.
8,141,998 B2 3/2012 Nozawa et al.

(Continued)

FOREIGN PATENT DOCUMENTS

CA 2782610 A1 12/2011
CN 102285237 A 12/2011

(Continued)

*Primary Examiner* — Stephen Meier
*Assistant Examiner* — Alexander D Shenderov
(74) *Attorney, Agent, or Firm* — Global IP Counselors, LLP

(57) ABSTRACT

A mounting member includes a position alignment member, an attachment member and a moving member. The position alignment member is positionally aligned with respect to a liquid consumption apparatus in three directions. The attachment member is attached to the position alignment member and includes an inner portion flow path and a liquid supply port. The moving member is attached to the attachment member, and configured and arranged to move according to pressure changes in the inner portion flow path. The moving member is disposed at a position that faces and contacts one end portion of a rod-shaped member provided in the liquid consumption apparatus when the mounting member is mounted in the liquid consumption apparatus so that displacement of the other end portion of the rod-shaped member is detected by a sensor that detects a liquid remaining amount state of the liquid supply source.

8 Claims, 25 Drawing Sheets

(56) References Cited

U.S. PATENT DOCUMENTS

| | | | |
|---|---|---|---|
| 8,197,045 | B2 | 6/2012 | Takeuchi |
| D682,929 | S | 5/2013 | Aoki et al. |
| D682,930 | S | 5/2013 | Aoki et al. |
| D682,931 | S | 5/2013 | Aoki et al. |
| D712,466 | S | 9/2014 | Nagashima et al. |
| 2003/0234844 | A1 | 12/2003 | Yamamoto et al. |
| 2006/0012638 | A1 | 1/2006 | Lee |
| 2006/0038865 | A1 | 2/2006 | Nagasaki et al. |
| 2008/0049081 | A1 | 2/2008 | Hayashi et al. |
| 2008/0151018 | A1 | 6/2008 | Aoki et al. |
| 2008/0198211 | A1 | 8/2008 | Aoki et al. |
| 2008/0252669 | A1 | 10/2008 | Aoki et al. |
| 2008/0252702 | A1 | 10/2008 | Aoki et al. |
| 2008/0316249 | A1 | 12/2008 | Aoki et al. |
| 2009/0064501 | A1 | 3/2009 | Kimura et al. |
| 2009/0289971 | A1 | 11/2009 | Gilson et al. |
| 2009/0303299 | A1 | 12/2009 | Gilson et al. |
| 2011/0198360 | A1 | 8/2011 | Aoki |
| 2011/0199439 | A1 | 8/2011 | Aoki |
| 2012/0147102 | A1 | 6/2012 | Aoki et al. |
| 2012/0200646 | A1 | 8/2012 | Karasawa et al. |
| 2012/0200871 | A1 | 8/2012 | Takahashi et al. |
| 2012/0212526 | A1 | 8/2012 | Karasawa et al. |
| 2012/0242762 | A1 | 9/2012 | Gilson et al. |
| 2013/0182050 | A1 | 7/2013 | Aoki et al. |
| 2013/0182051 | A1 | 7/2013 | Aoki et al. |
| 2013/0186513 | A1 | 7/2013 | Aoki et al. |
| 2013/0187993 | A1 | 7/2013 | Aoki et al. |
| 2013/0188985 | A1 | 7/2013 | Takahashi et al. |
| 2013/0194357 | A1 | 8/2013 | Karasawa et al. |
| 2013/0201260 | A1 | 8/2013 | Aoki et al. |
| 2013/0223877 | A1 | 8/2013 | Takahashi et al. |
| 2013/0278687 | A1 | 10/2013 | Karasawa et al. |
| 2013/0307908 | A1 | 11/2013 | Aoki et al. |

FOREIGN PATENT DOCUMENTS

| | | | |
|---|---|---|---|
| EP | 1504908 | A2 | 2/2005 |
| EP | 1547783 | A2 | 6/2005 |
| EP | 1892103 | A2 | 2/2008 |
| EP | 2308337 | A1 | 12/2011 |
| EP | 2397336 | A1 | 12/2011 |
| JP | 2007-083677 | A | 4/2007 |
| JP | 2008-273173 | A | 11/2008 |
| JP | 2010-155465 | A | 7/2010 |
| JP | 2012-226289 | A | 11/2012 |

* cited by examiner

MOUNTING MEMBER, LIQUID CONTAINER WITH MOUNTING MEMBER, AND LIQUID SUPPLY SYSTEM

CROSS-REFERENCE TO RELATED APPLICATIONS

This application claims priority to Japanese Patent Application No. 2012-005347 filed on Jan. 13, 2012, Japanese Patent Application No. 2012-013238 filed on Jan. 25, 2012, and Japanese Patent Application No. 2012-022813 filed on Feb. 6, 2012, the disclosures of which are hereby incorporated herein by reference in its entirety.

TECHNICAL FIELD

The present invention relates to a mounting member which is mounted in a liquid consumption apparatus, a liquid container which is provided with the mounting member, and a liquid supply system.

PRIOR ART

A printer, which is an example of a liquid consumption apparatus, performs printing by discharging ink from a print head onto a recording target (for example, printing paper). The ink supply to the print head is performed through an ink cartridge (also simply referred to as a "cartridge") which is accommodated in an inner portion of an ink supply source.

There are cases where a sensor for detecting the state of the remaining amount of ink is provided (for example, patent literature 1 and 2) in order for it to be possible for a user to replace the cartridge at a point in time when ink in the ink supply source runs out or when the remaining amount of ink is very small.

For example, in the technique in Japanese Unexamined Patent Application Publication No. 2008-273173, the state of the remaining amount of ink is detected using a remaining ink amount detection means which is provided in a cartridge. The remaining ink amount detection means detects the state of the remaining amount of ink using a piezoelectric element. In addition, for example, in the technique in Japanese Unexamined Patent Application Publication No. 2010-155465, the state of the remaining amount of ink is detected using an optical sensor which is provided in a refill unit and a portion to be detected which is provided inside the cartridge.

SUMMARY

In the technique in Japanese Unexamined Patent Application Publication No. 2008-273173, a piezoelectric element which is a sensor for detecting the state of the remaining amount of ink is provided in the cartridge side. As a result, there are cases where the cost of the cartridge increases. On the other hand, in the technique in Japanese Unexamined Patent Application Publication No. 2010-155465, a sensor for detecting the state of the remaining amount of ink is provided in the refill unit side, and it is not necessary to provide a sensor at the cartridge side. However, in the technique in this publication, consideration is not given to a position aligning means for arranging the portion to be detected at a predetermined position inside the ink cartridge with high precision. As a result, there is a concern that detection precision of the state of the remaining amount of ink using the portion to be detected and the sensor may be reduced.

Here, without being limited to a cartridge which accommodates ink for printing or a printing apparatus, the various types of problems as described above are common to mounting members which are provided with a member which is mounted in a liquid consumption apparatus, which is provided with a sensor, and which are used in the detection of the state of the remaining amount of ink.

Based on the problems described above, the present invention has an object of providing a technique where it is possible to suppress a reduction in detection precision of the state of the remaining amount of ink in a technique where the state of the remaining amount of ink in an ink supply source is detected using a sensor at a liquid consumption apparatus side.

The present invention has been made to solve at least a portion of the problems described above and is able to be realized in the following forms or aspects.

A mounting member according to one aspect is adapted to be mounted on a liquid consumption apparatus to be able to be attached and detached. The mounting member includes a position alignment member which is positionally aligned by regulating movement in three directions, which are respectively parallel to three coordinate axes which are orthogonal to each other including an attaching and detaching coordinate axis which extends in a direction in which the mounting member is attached and detached, using a mounting section of the liquid consumption apparatus, an attachment member which is attached to the position alignment member, which is positionally aligned by regulating the movement in the three directions using the position alignment member, and where an inner portion flow path, where liquid from a liquid supply source which accommodates liquid is circulated and where a liquid supply port which is an end portion is connected to the liquid consumption apparatus, is formed, and a moving member which is attached to the attachment member such that displacement is possible in a direction along at least the attaching and detaching coordinate axis in accompaniment with pressure changes in the inner portion flow path, wherein the moving member is a rod-shaped member which is provided in the liquid consumption apparatus when the mounting member is mounted in the liquid consumption apparatus, is provided at a position which faces another end portion of the rod-shaped member in which displacement of one end portion is detected by a sensor for detecting a liquid remaining amount state of the liquid supply source, and comes into contact with the other end portion when the mounting member is mounted in the liquid consumption apparatus.

According to the mounting member according to this aspect, there is provided the position alignment member for which movement is regulated in three directions by the mounting section of the liquid consumption apparatus and the attachment member for which the movement is regulated in three directions by the position alignment member. In addition, the moving member is attached to the attachment member. Due to this, it is possible to reduce the possibility that the positional relationship of the moving member and the rod-shaped member of the liquid consumption apparatus will deviate from the correct positional relationship. As such, it is possible to suppress a reduction in detection precision of the state of the remaining amount of ink using the rod-shaped member and the sensor which are provided in the moving member and the liquid consumption apparatus.

In the mounting member according to the above described aspect, the position alignment member is preferably a box shape with one side opened, and a plurality of sets of regulating sections, which perform positional alignment of the attachment member in the three directions by abutting against the attachment member and which include two or more sets of regulating sections which perform positional alignment in directions in which at least a portion are different to each other, are provided in an inner wall of the position alignment member.

According to the mounting member according to this aspect, it is possible for the attachment member to be easily positionally aligned by providing a plurality of sets of regulating sections which perform positional alignment with regard to directions in which at least a portion are different to each other in the inner wall of the position alignment member.

In the mounting member according to the above described aspect, when an axis which extends in a direction in which a bottom portion of the position alignment member with the box shape and the opening are opposed is the attaching and detaching coordinate axis, and among the directions along the attaching and detaching coordinate axis, a direction from the bottom portion to the opening is set as a +Y direction and a direction from the opening to the bottom portion is set as a −Y direction, the plurality of sets of regulating sections preferably have +Y axis abutting sections which regulate movement of the attachment member in the +Y axis direction by abutting against the attachment member and −Y axis abutting sections which regulate movement of the attachment member in the −Y axis direction by abutting against the attachment member, and the number of the +Y axis abutting sections is smaller than the number of the −Y axis abutting sections.

According to the mounting member according to this aspect, by reducing the number of the +Y axis abutting sections to be less than the number of the −Y axis abutting sections, it is possible to reduce frictional resistance between the +Y axis abutting sections and the attachment member when the attachment member is assembled with the position alignment member from the opening. Due to this, it is possible to easily assemble the attachment member with the position alignment member.

In the mounting member according to the above described aspect, when an axis which extends in a direction in which the bottom portion of the position alignment member with the box shape and the opening are opposed is the Y axis which is the attaching and detaching coordinate axis and two axes which are different to the Y axis among the three coordinate axes are set as an X axis and a Z axis, the plurality of sets of regulating sections preferably have a plurality of X axis regulating sections which regulate the movement in the X axis direction by abutting against the attachment member and which are arranged at positions which sandwich at least one of a center line of a length of an abutted member in the Y axis direction and a center line of a length of the abutted member in the Z axis direction, a plurality of Y axis regulating sections which regulate the movement in the Y axis direction by abutting against the attachment member and which are arranged at positions which sandwich at least one of a center line of a length of the abutted member in the Z axis direction and a center line of a length of the abutted member in the X axis direction, and a plurality of Z axis regulating sections which regulate the movement in the Z axis direction by abutting against the attachment member and which are arranged at positions which sandwich at least one of a center line of a length of the abutted member in the X axis direction and a center line of a length of the abutted member in the Y axis direction.

According to the mounting member according to this aspect, it is possible to suppress deviations in position of the attachment member with regard to the position alignment member using the X axis regulating sections, the Y axis regulating sections, and the Z axis regulating sections even in a case where the abutted member is a predetermined size.

In the mounting member according to any one of the above described aspects, the inner portion flow path preferably has a liquid chamber where the volume changes in accompaniment with pressure changes in the inner portion and in which a portion of a wall which forms a partition in the liquid chamber is formed by a shape changing member which changes shape in accompaniment with pressure changes inside the liquid chamber, and the moving member has an attaching section which attaches to the attachment member, which forms a fulcrum, and which displaces the moving member in a direction along at least the attaching and detaching coordinate axis, a first contact section which comes into contact with the shape changing member from the outside of the liquid chamber, and a second contact section which is positioned at a side which is opposite to the fulcrum so as to interpose the first contact section and which comes into contact with the other end portion of the rod-shaped member.

According to the mounting member according to this aspect, the second contact section of the moving member which comes into contact with the other end portion of the rod-shaped member is positioned at the opposite side to the fulcrum so as to interpose the first contact section. Due to this, the displacement of the second contact section is greater than the displacement of the first contact section. As such, it is possible to improve detection precision of the displacement of the one end portion of the moving member using the sensor, and it is possible to improve precision of the liquid remaining amount detection.

A liquid container according to another aspect is provided with the mounting member according to any one of the above described aspects, and a liquid retaining body as the liquid supply source which retains the liquid which is supplied to the liquid consumption apparatus through the liquid supply port.

According to the liquid container according to this aspect, it is possible to provide a liquid container where it is possible to suppress a reduction in precision of the liquid remaining amount detection.

The liquid container according to the above described aspect is preferably further provided with a protective member which accommodates the liquid accommodating body, wherein the protective member is assembled so as to be able to move with regard to the position alignment member.

The protective member side which accommodates the liquid retaining body is typically heavier compared to the position alignment member side. As a result, there are cases where the protective member side is inclined with regard to the horizontal direction by the effect of gravity. However, according to the liquid container according to this aspect, the protective member is assembled so as to be able to move with regard to the position alignment member. As such, it is possible to suppress inclining of the position alignment member even in a case where the protective member is inclined with regard to the horizontal direction by configuring the protective member so as to move slightly with regard to the position alignment member to the extent of the clearance between the protective member and the position alignment member. That is, it is possible for the position alignment member to maintain the correct posture and it is possible to reduce the possibility that the positional relationship of the moving member and the rod-shaped member will deviate from the correct positional relationship. As such, it is possible to suppress a reduction in precision of the liquid remaining amount detection.

A liquid supply unit according to another aspect is provided with the mounting member according to any one of the above described aspects, an external liquid retaining body which is a liquid supply source which retains the liquid, which is supplied to the liquid consumption apparatus through the liquid supply port outside the liquid consumption apparatus and the mounting member, and a liquid transporting tube which links the external liquid retaining body and the mounting member.

According to the liquid supply unit according to this aspect, it is possible to provide a liquid supply unit where it is possible to suppress a reduction in precision of the liquid remaining amount detection.

Here, it is possible to realize the present invention in various forms, and in addition to the configuration as the mounting member, the liquid container, and the liquid supply unit described above, it is possible to realize a form of a method of manufacturing the mounting member, the liquid container, and the liquid supply unit, or a liquid consumption system or the like which is provided with a liquid consumption apparatus and at least one of the mounting member, the liquid container, and the liquid supply unit.

DESCRIPTION OF THE EMBODIMENTS

Next, an embodiment of the present invention will be described in the following order: A. Example; and B. Modified Examples.

A: Example

A-1. Overall Configuration of Liquid Consumption System

Figure 1:
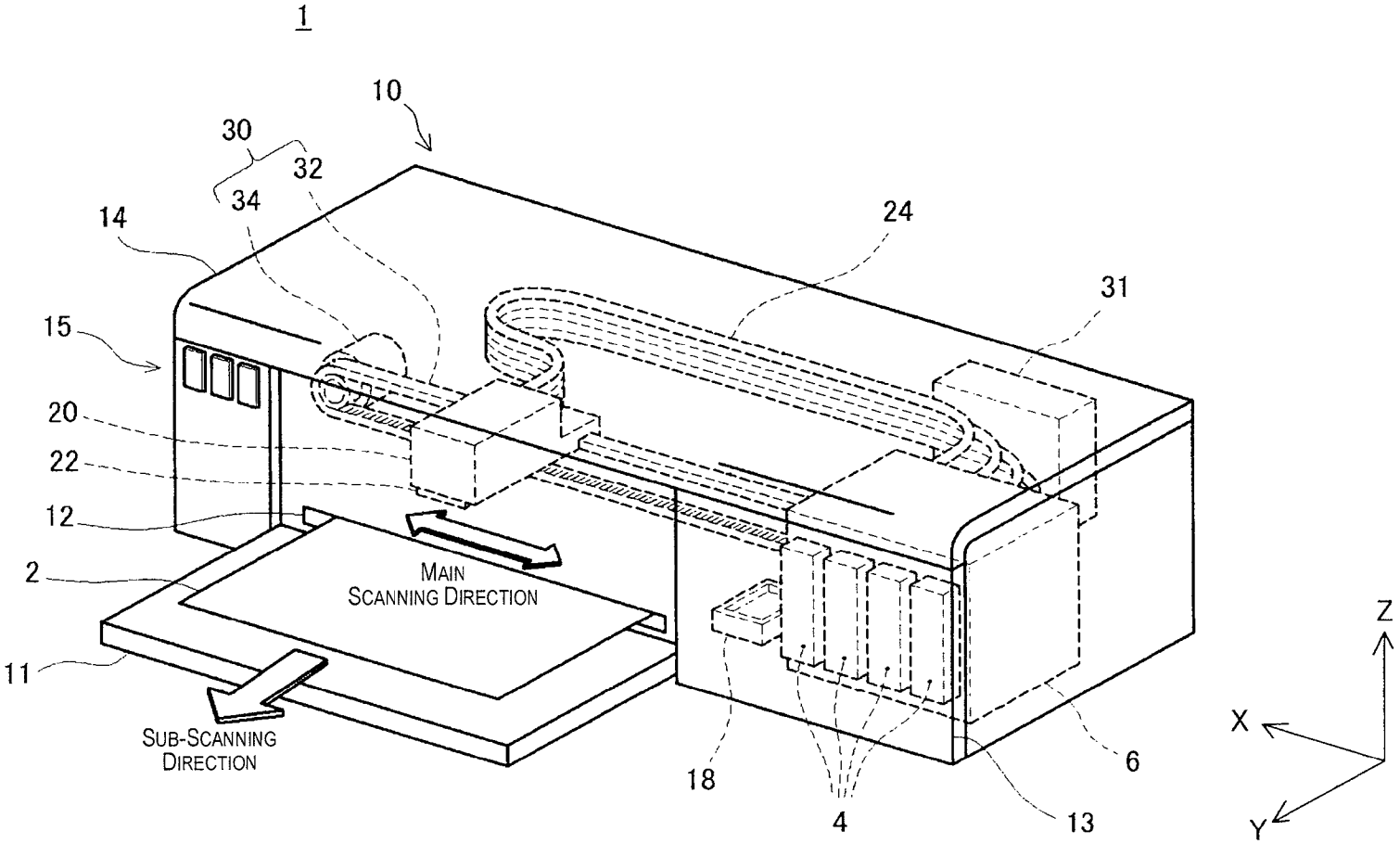
FIG. 1 is a diagram for describing a liquid consumption system 1 as an applied example of the present invention.

FIG. 1 is a diagram for describing a liquid consumption system 1 as an applied example of the present invention. In FIG. 1, X, Y, and Z axes are drawn to intersect with each other. For the diagrams which are illustrated below, the X, Y, and Z axes are drawn according to necessity. The X, Y, and Z axes which are drawn in other diagrams correspond to the directions of the X, Y, and Z axes in FIG. 1. The liquid consumption system 1 is provided with a printer 10 which is a liquid consumption apparatus and a cartridge 4 which is a liquid container.

The printer 10 of the present embodiment is an ink jet printer which discharges ink from a head 22. The printer 10 is a large scale printer which performs printing on large format paper (A2 to A0, or the like) such as posters. The printer 10 is provided with a mounting section 6, a control section 31, a carriage 20, the head 22, and a driving mechanism 30. In addition, the printer 10 is provided with operation buttons 15 for the user to operate actions of the printer 10.

A plurality of cartridges 4 are each mounted in the mounting section 6 to be able to be attached and detached. In the present applied example, four types of cartridge 4 corresponding to ink of four colors (black, yellow, magenta, and cyan), that is, a total of four cartridges 4, are mounted in the mounting section 6 one by one. In the printer 10 of the present applied example, a replacement cover 13 is provided at the front surface (surface of the +Y axis direction side). When the +Z axis direction side of the replacement cover 13 falls toward the front side (the +Y axis direction side), an opening appears in the mounting section 6 and it is possible to attach and detach the cartridge 4. When the cartridge 4 is mounted in the mounting section 6, it is possible to supply ink to the head 22 which is provided in the carriage 20 through hoses 24. In the present applied example, ink is supplied to the head 22 by suctioning the ink inside the cartridge 4 using a suction pump (which is not shown in the diagram) of the printer 10. Here, the hoses 24 are provided for each type of ink. Here, the state in which the carriage 4 is mounted in the mounting section 6 is also referred to as the "mounted state".

In the head 22, nozzles are provided for each type of ink. The head 22 prints data such as text or an image by ejecting ink toward printing paper 2 from the ejection nozzles. Here, in the present applied example, the printer 10 is a printer which is referred to as a so-called "off-carriage type" in which the mounting section 6 is not linked to the movement of the carriage 20. It is also possible to apply the present invention to a printer which is referred to as a so-called "on-carriage type" in which the mounting section 6 is provided in the carriage 20 and the mounting section 6 moves along with the carriage 20.

The control section 31 performs control of each of the sections of the printer 10 and transmits and receives signals to and from the cartridge 4. The carriage 20 moves the head 22 relatively with regard to the printing paper 2.

The driving mechanism 30 reciprocally moves the carriage based on a control signal from the control section 31. The driving mechanism 30 is provided with a timing belt 32 and a driving motor 34. By transmitting driving power of the driving motor 34 to the carriage 20 through the timing belt 32, the carriage 20 is reciprocally moved in the main scanning direction (the X axis direction). In addition, the printer 10 is provided with a transport mechanism for moving the printing paper 2 in the sub-scanning direction (the +Y axis direction). When printing is performed, the printing paper 2 is moved in the sub-scanning direction by the transport mechanism, and the printing paper 2 is output onto a front surface cover 11 through an opening 12 after the printing is completed.

In addition, a region which is referred to as a home position is provided in a position outside of the printing region in which the carriage 20 is moved in the main scanning direction and a maintenance mechanism which performs maintenance such that printing is normally possible is mounted at the home position. The maintenance mechanism is configured by a cap member 18 which is pressed onto a surface (a nozzle surface) in which nozzles are formed at the bottom surface side (a side which faces the printing paper 2) of the head 22 and which forms a closed space so as to surround the ejection nozzles, an elevating mechanism (which is not shown in the diagram) which raises and lowers the cap member 18 so as to be pressed onto the nozzle surface of the head 22, a suction pump (which is not shown in the diagram) which introduces a negative pressure into the closed space which is formed by the cap member 18 being pressed onto the nozzle surface of the head 22, and the like.

In the present applied example, in a state where the liquid consumption system 1 (the printer 10 and the cartridge 4) is used, the axis which is along the sub-scanning direction in which the printing paper 2 is transported is set as the Y axis, the axis which is along the direction of gravity (the vertical direction) is set as the Z axis, and the axis which is along the moving direction (the lateral direction) of the carriage 20 is set as the X axis. Here, the "a state where the liquid consumption system 1 is used" refers to a state where the liquid consumption system 1 is placed on a flat surface. In addition, in the present applied example, the sub-scanning direction (the forward direction) is set as the +Y axis direction and the direction which is the opposite to this (the backward direction) is set as the −Y axis direction, and the direction which heads from the bottom to the top in the direction of gravity (the upward direction) is set as the +Z axis direction and the direction which is the opposite to this (the downward direction) is set as the −Z axis direction. In addition, when the liquid consumption system 1 is viewed from the front side (the +Y axis direction side), the direction which heads from the right side to the left side is set as the +X axis direction and the direction which is the opposite to this is set as the −X axis direction. In addition, in the present applied example, the insertion direction when the cartridge 4 is mounted in the mounting section 6 is the −Y axis direction and the direction when the cartridge 4 is detached from the mounting section 6 is the +Y axis direction. As such, in the mounting section 6, the −Y axis direction side is also referred to as the rear side and the +Y axis direction is also referred to as the front side. In addition, in the present applied example, the arrangement direction of the plurality of cartridges 4 is the X axis direction.

A-2. Detailed Configuration of Mounting Section 6

Figure 2:
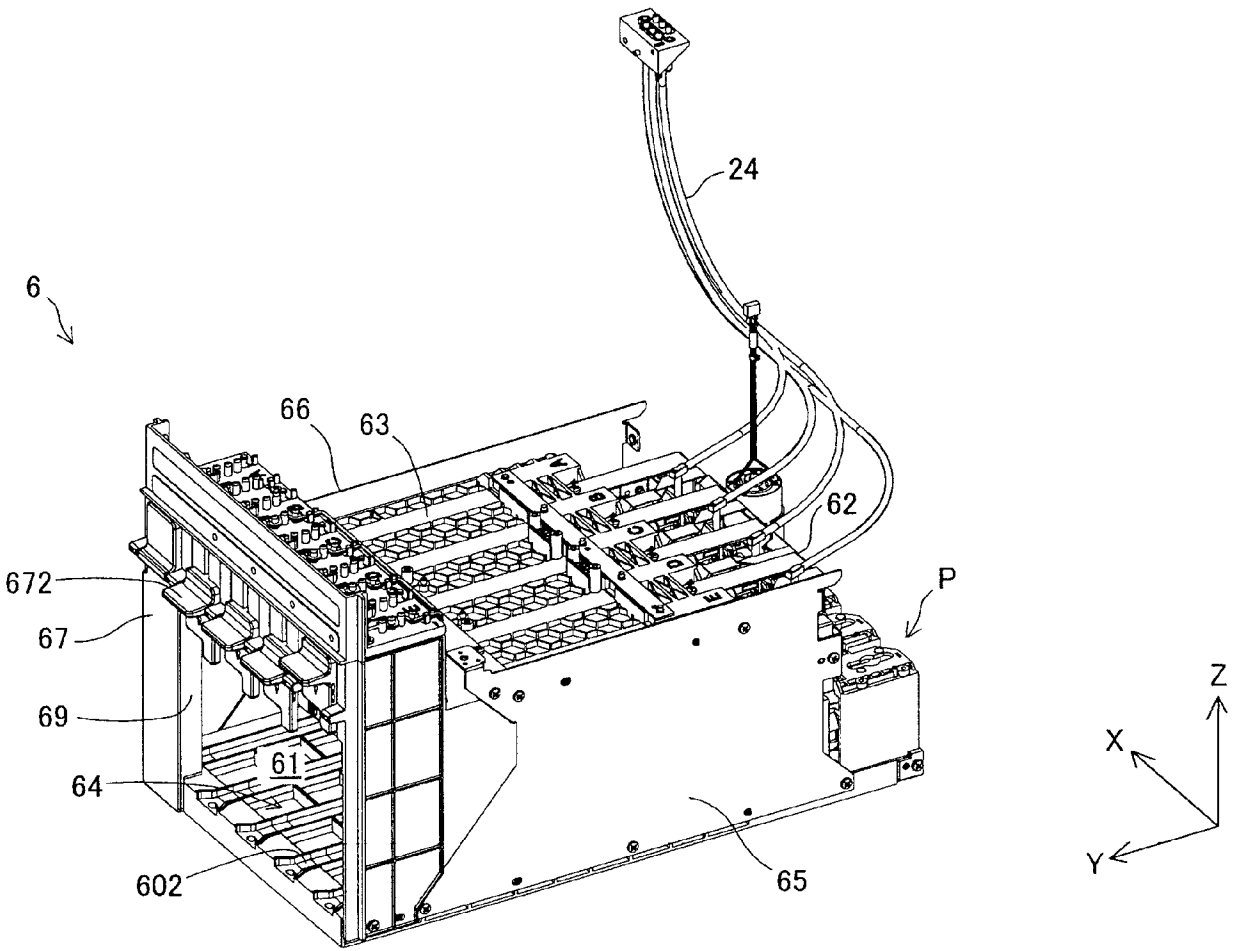
FIG. 2 is a first perspective diagram of the external appearance of a mounting section 6.
Figure 3:
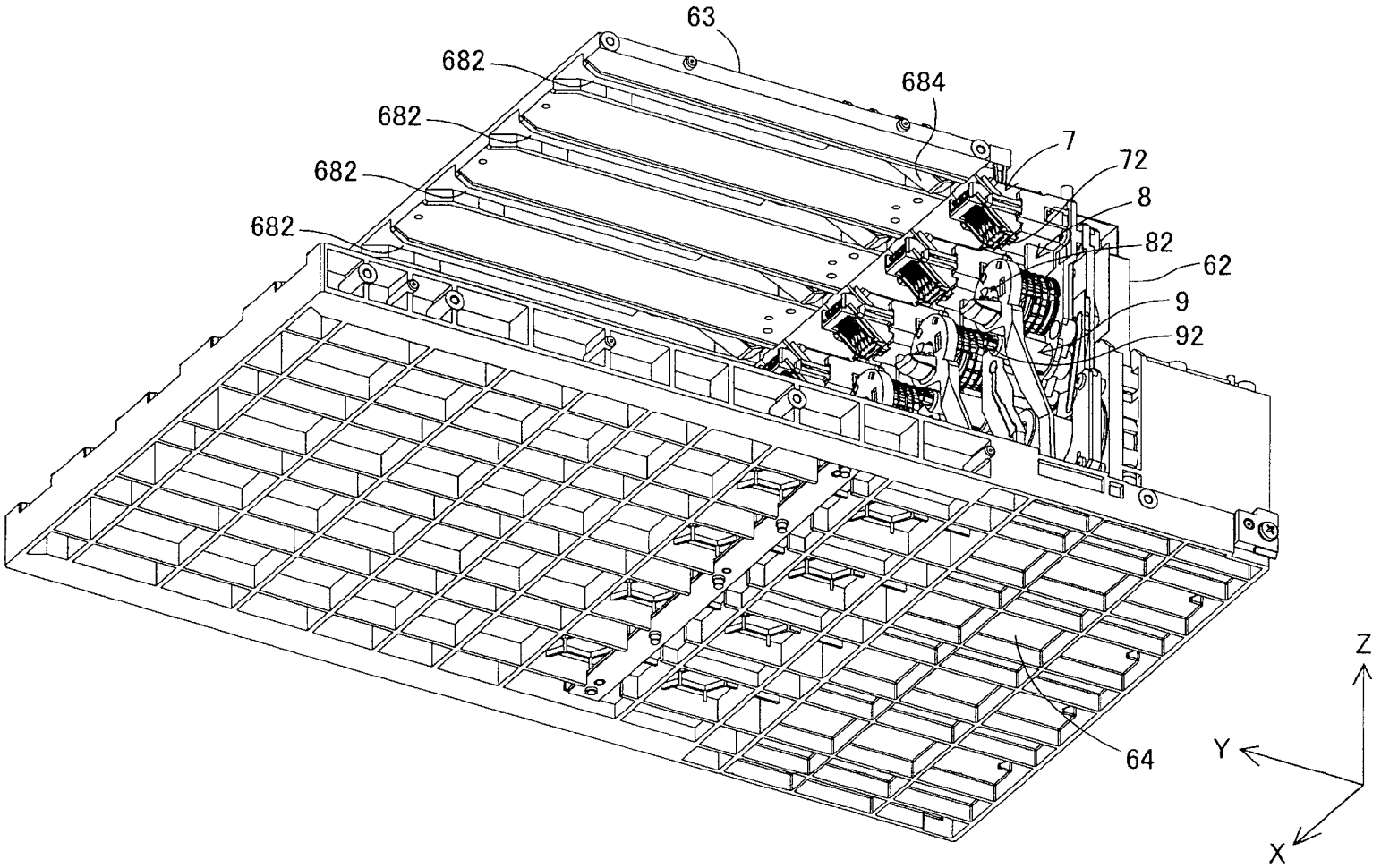
FIG. 3 is a second perspective diagram of the external appearance of the mounting section 6.
Figure 4:
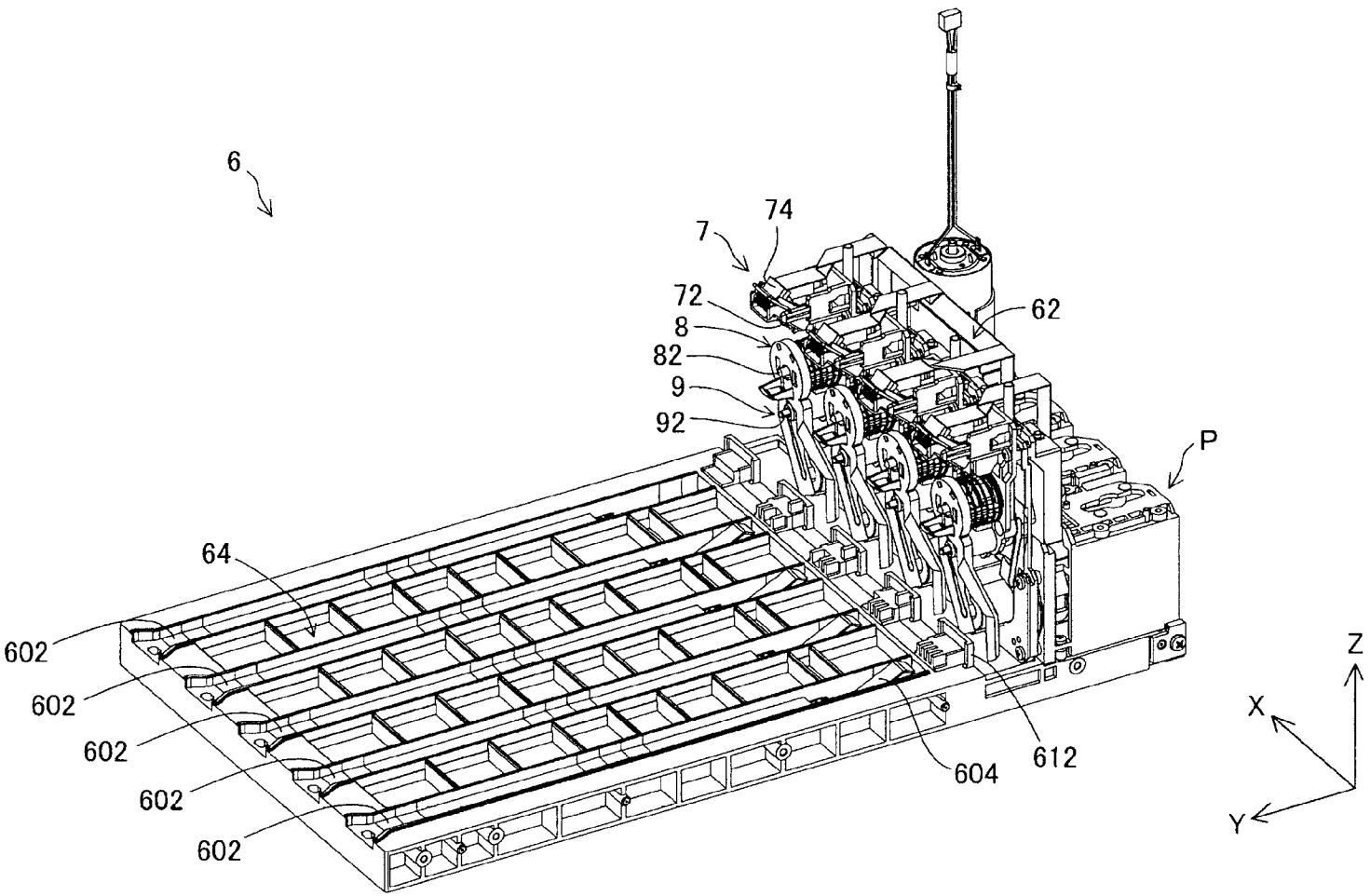
FIG. 4 is a third perspective diagram of the external appearance of the mounting section 6.

Next, the detailed configuration of the mounting section 6 will be described using FIG. 2 to FIG. 4. FIG. 2 is a first perspective diagram of the external appearance of the mounting section 6. FIG. 3 is a second perspective diagram of the external appearance of the mounting section 6. FIG. 4 is a third perspective diagram of the external appearance of the mounting section 6. FIG. 2 also shows the hoses 24 which are attached to the mounting section 6. FIG. 3 and FIG. 4 omit to show a portion of a wall section which forms a partition in the mounting section 6 in order to carry out an explanation of the configuration of the inner portion of the mounting section 6.

As shown in FIG. 2, in the mounting section 6, a cartridge accommodating chamber 61 which accommodates cartridges 4 is formed and partitioned by six wall sections which will be described below. The cartridge accommodating chamber 61 has a substantially rectangular shape. Here, in the cartridge accommodating chamber 61, portions which accommodate one out of the four cartridges 4 are each called slots.

The mounting section 6 is provided with an apparatus side front wall section 62, a first apparatus side side wall 63, and a second apparatus side side wall 64. In addition, the mounting section 6 is provided with a third apparatus side side wall 65, a fourth apparatus side side wall 66, and an opening wall section 67. The cartridge accommodating chamber 61 is formed and partitioned by the six wall sections 62, 63, 64, 65, 66, and 67. The outer shapes of the six wall sections 62, 63, 64, 65, 66, and 67 are each substantially rectangular shapes.

The apparatus side front wall section 62 and the opening wall section 67 are opposed to each other. The first apparatus side side wall 63 and the second apparatus side side wall 64 are opposed to each other. The third apparatus side side wall 65 and the fourth apparatus side side wall 66 are opposed to each other.

An opening 69 through which the cartridges 4 passes when being attached and detached is formed in the opening wall section 67. In addition, a lever 672 which is able to move in the Z axis direction is provided in the opening wall section 67. By moving the lever 672 in the −Z axis direction after the cartridge 4 is mounted, the lever 672 is caught in the cartridge 4. Due to this, the cartridge 4 is prevented from being removed by mistake. The cartridge 4 is attached and detached in the mounting section 6 along the Y axis direction. That is, the Y axis direction is the attaching and detaching coordinate axis which extends along the direction in which the cartridge 4 is attached and detached. In addition, the +Y axis direction is the direction in which the cartridge 4 is removed and the −Y axis direction is the direction in which the cartridge 4 is mounted.

Suction pumps P for suctioning the ink inside the cartridge 4 are arranged at the −Y axis direction side of the apparatus side front wall section 62. The suction pumps P are provided to correspond to the number of cartridges 4 which are mounted.

As shown in FIG. 3, the first apparatus side side wall 63 has a first rail 682 which regulates the movement of the cartridge 4 in the Y axis direction in the mounted state. In addition, the first rail 682 guides the cartridge 4 up to the mount position. The first rail 682 is provided to correspond to at least the number of cartridges 4 which are mounted. In the present applied example, four of the cartridges 4 which are actually mounted and a total of five of the first rails 682 with one spare are provided. The first rails 682 are grooves which extend in the Y axis direction and a portion of the cartridges 4 is inserted therein. In addition, a leaf spring 684 is provided as a locking member in the −Y axis direction side end portion of the first rails 682. In the mounted state, the cartridge 4 is prevented from being pulled out from the mounting section 6 by the leaf spring 684 locking with the cartridge 4.

As shown in FIG. 4, the second apparatus side side wall 64 has a second rail 602 which regulates the movement of the cartridge 4 in the Y axis direction in the mounted state. In addition, the second rail 602 guides the cartridge 4 up to the mount position. The second rail 602 is provided to correspond to at least the number of cartridges 4 which are mounted. In the present applied example, four of the cartridges 4 which are actually mounted and a total of five of the second rails 602 with one spare are provided. The second rails 602 are grooves which extend in the Y axis direction and a portion of the cartridges 4 is inserted therein. In addition, a leaf spring 604 is provided as a locking member in the −Y axis direction side end portion of the second rails 602. In the mounted state, the cartridge 4 is prevented from being pulled out from the mounting section 6 by the leaf spring 604 locking the cartridge 4. That is, the movement of the cartridge 4 in the −Y axis direction is regulated.

In addition, a regulating member 612 is provided in the second apparatus side side wall 64 in a position in the vicinity of the apparatus side front wall section 62. The regulating member 612 is provided to correspond to at least the number of cartridges 4 which are mounted. In the present applied example, five of the regulating members 612 are provided but the number which is actually used is four. The regulating members 612 abut against the cartridges 4 when the cartridges 4 are inserted into the cartridge accommodating chamber 61 through the opening 69 (FIG. 2) and reach the correct mounting position. That is, the movement of the cartridge 4 in the −Y axis direction is regulated.

Here, when the cartridge 4 is detached from the mounting section 6, the lever 672 (FIG. 2) is moved in the +Z axis direction and the cartridge 4 is pulled out to the −Y axis direction side. When the cartridge 4 is pulled out to the −Y axis direction side, the leaf springs 604 and 684 are displaced so as to be respectively accommodated in the rails 602 and 682, and the locking is released.

As shown in FIG. 4, an apparatus side terminal section 7, a liquid supply mechanism 8, and a rod member 9 are provided in the apparatus side front wall section 62. The apparatus side terminal section 7 is provided with an apparatus side terminal group 72, which is formed of a plurality of terminals, and a connector 74. The apparatus side terminal group 72 is electrically connected to the connector 74. The apparatus side terminal group 72 is electrically connected by being in contact with a circuit board (which will be described later) which is provided in the cartridge 4 in the mounted state. The connector 74 is electrically connected to the control section 31 (FIG. 1) of the printer 10 by wiring. Due to this, it is possible to transmit and receive signals between the circuit board of the cartridge 4 and the control section 31.

The liquid supply mechanism 8 is provided with a liquid supplying needle 82. In the mounted state, the liquid supplying needle 82 is connected to the cartridge 4. Due to this, it is possible to circulate ink which is accommodated in the cartridge 4 to the liquid supplying needle 82. Here, the liquid supplying needle 82 is linked with the hose 24.

The rod member 9 is provided with a rod-shaped member 92. The rod-shaped member 92 is a member which extends along the Y axis direction. The rod-shaped member 92 is provided so as to be able to move along the Y axis direction. In the present applied example, the rod-shaped member 92 is provided to pass though the apparatus side front wall section 62. The rod-shaped member 92 configures a portion of a detection mechanism for detecting the state of the remaining amount of ink of the cartridge 4. Here, in the present applied example, the state where the ink has run out in the cartridge 4 is detected by the detection mechanism. Here, the "state where the ink has run out" refers to a state where there is no ink in the cartridge 4 or a state where the ink in the cartridge 4 is running low. Here, the details of the detection mechanism will be described later.

A-3. External Configuration of Cartridge

Figure 5:
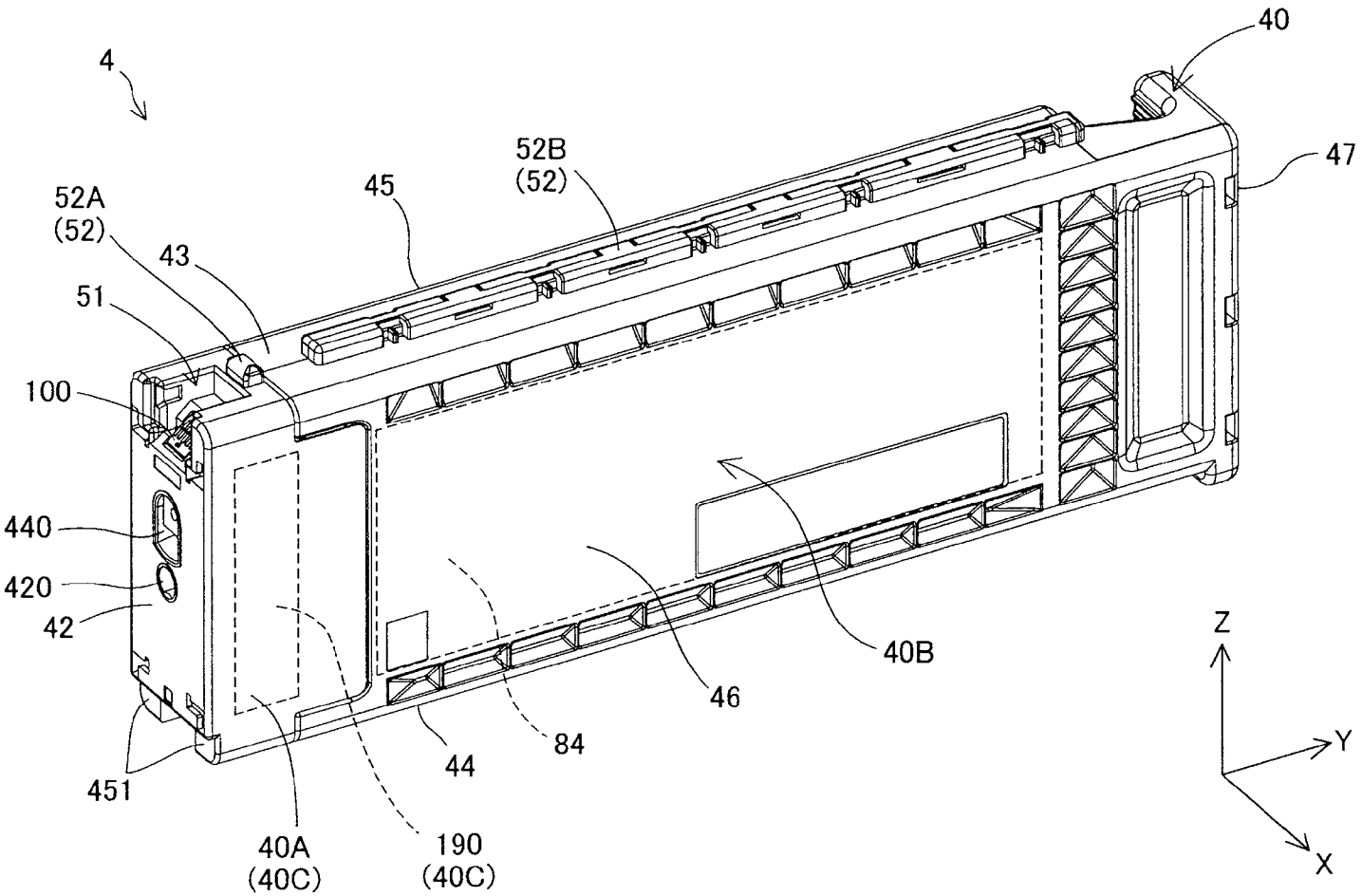
FIG. 5 is a perspective diagram of the external appearance of a cartridge 4.
Figure 6:
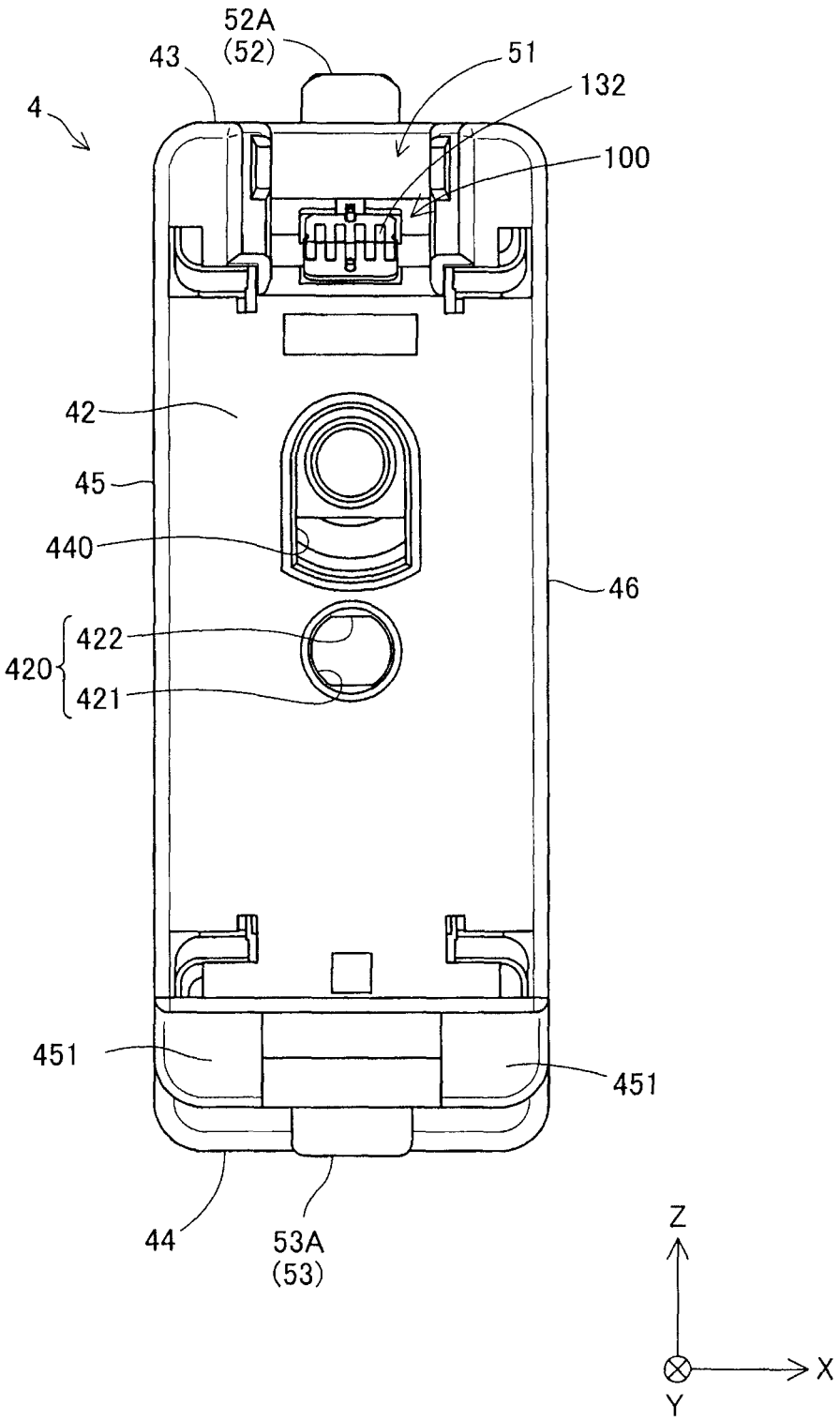
FIG. 6 is a front surface diagram of the cartridge 4.
Figure 7:
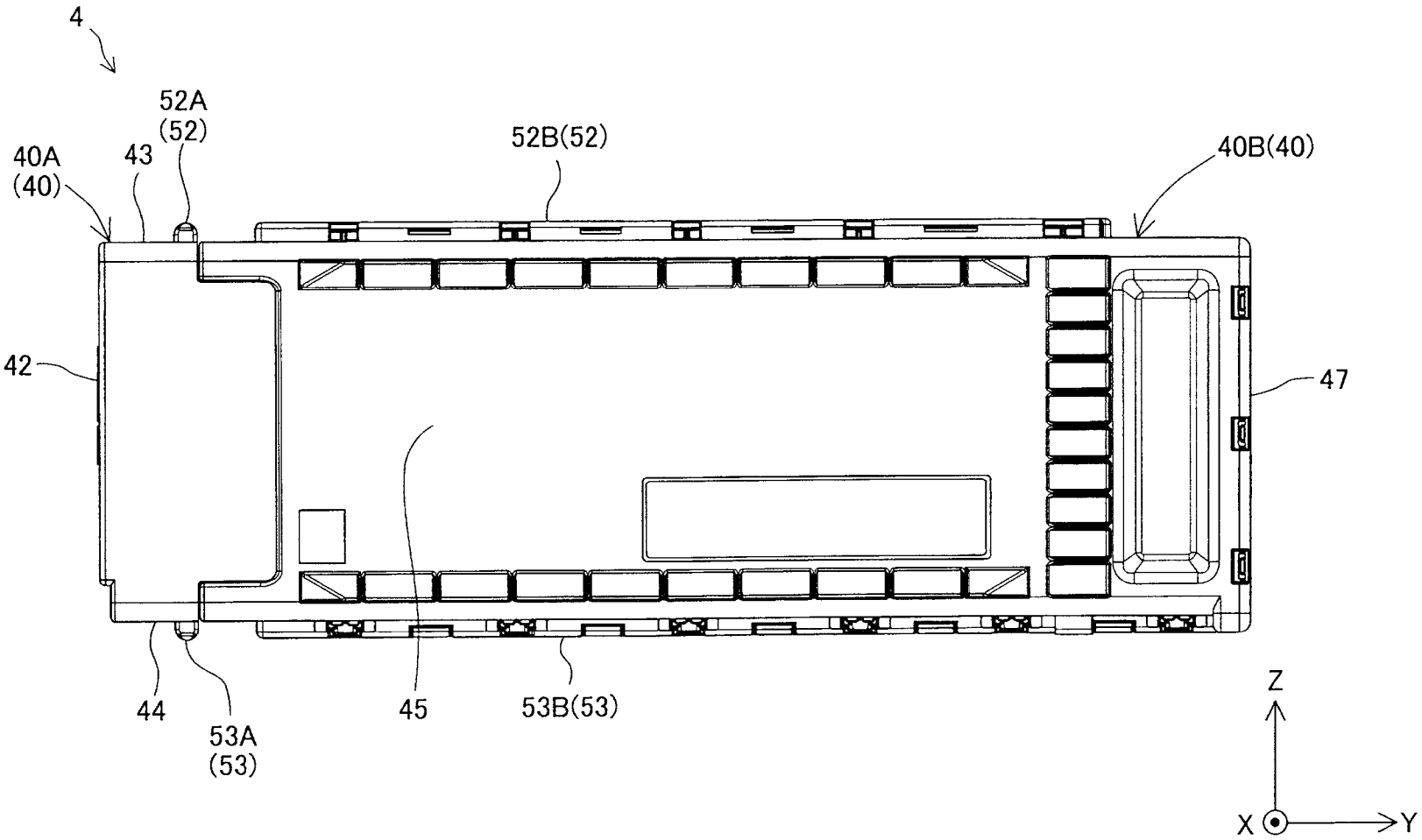
FIG. 7 is a side surface diagram of the cartridge 4.

Next, the external configuration of the cartridge 4 will be described using FIG. 5 to FIG. 7. FIG. 5 is a perspective diagram of the external appearance of the cartridge 4. FIG. 6 is a front surface diagram of the cartridge 4. FIG. 7 is a side surface diagram of the cartridge 4.

As shown in FIG. 5, the outer shape of the cartridge 4 has a substantially rectangular shape. The cartridge 4 is provided with a case 40. The case 40 is formed using a synthetic resin. The case 40 is provided with a position alignment member 40A where the liquid supplying needle 82 and the rod-shaped member 92 of the mounting section 6 are inserted and a protective member 40B which is attached to the position alignment member 40A. The protective member 40B is attached to provide a clearance so as to be able to slightly move with regard to the position alignment member 40A. The case 40 accommodates a liquid accommodating section (a liquid retaining body) 84 which is a liquid supply source and an attachment member 190, where an inner portion flow path in which ink of the liquid accommodating portion 84 is circulated to the liquid supplying needle 82 is formed, in the inner portion thereof. In detail, the attachment member 190 is attached to the inner portion of the position alignment member 40A. In addition, the liquid accommodating section 84 is accommodated in the inner portion of the protective member 40B. Here, the detailed configurations of the liquid accommodating section 84 and the attachment member 190 will be described later. Here, the position alignment member 40A and the attachment member 190 are constituent members of a mounting member 40C which will be described later.

The cartridge 4 is provided with a front wall 42, a rear wall 47, a first side wall 43, a second side wall 44, a third side wall 45, and a fourth side wall 46. Here, the first side wall 43 is also referred to as an upper wall 43, the second side wall 44 is also referred to as a bottom wall 44, the third side wall 45 is also referred to as the right side wall 45, and the fourth side wall 46 is also referred to as a left side wall 46. The front wall 42 and the rear wall 47 are opposed to each other. The first side wall 43 and the second side wall 44 are opposed to each other. The third side wall 45 and the fourth side wall 46 are opposed to each other.

As shown in FIG. 4 and FIG. 5, a supply needle insertion hole (which is also referred to as a "first insertion hole") 440 where the liquid supplying needle 82 is inserted and a rod insertion hole (which is also referred to as a "second insertion hole") 420 where the rod member 9 is inserted are formed in the front wall 42. As shown in FIG. 6, in the second insertion hole 420, a first portion 421 of the −Y axis direction side has a circular cross section (XZ cross section) which is parallel to the X axis direction and the Z axis direction, and a second portion 422 which is further to the +Y axis direction side than the first portion 421 has a shape where the largest dimension in the Z axis direction in the XZ cross section is smaller than the largest dimension in the X axis direction.

As shown in FIG. 5 and FIG. 6, the first side wall 43 has a first convex portion 52. The first convex portion 52 is inserted into the first rail 682 (FIG. 3). The first convex portion 52 has a first A portion 52A which is provided in the position alignment member 40A and a first B portion 52B which is provided in the protective member 40B. The first A portion 52A and the first B portion 52B are arranged through a predetermined space portion. In the mounted state, the leaf spring 684 (FIG. 3) is placed into the predetermined space portion between the first A portion 52A and the first B portion 52B. Due to this, the leaf spring 684 presses the first A portion 52A to the apparatus side front wall section 62 side (insertion direction side, −Y axis direction side, of the cartridge 4).

As shown in FIG. 6 and FIG. 7, the second side wall 44 has a second convex portion 53. The second convex portion 53 is inserted into the second rail 602 (FIG. 4). The second convex portion 53 has a second A portion 53A which is provided in the position alignment member 40A and a second B portion 53B which is provided in the protective member 40B. The second A portion 53A and the second B portion 53B are arranged through a predetermined space portion. In the mounted state, the leaf spring 604 (FIG. 4) is placed into the predetermined space portion between the second A portion 53A and the second B portion 53B. Due to this, the leaf spring 604 presses the second A portion 53A to the apparatus side front wall section 62 side (insertion direction side, −Y axis direction side, of the cartridge 4).

As described above, the movement of the cartridge 4 in the +Y axis direction in the mounted state is regulated by the leaf spring 684 pressing the first A portion 52A to the −Y axis direction side and the leaf spring 604 pressing the second A portion 53A to the −Y axis direction side.

As shown in FIG. 5, a concave portion 51 is formed at the corner where the front wall 42 and the first side wall 43 intersect. A circuit board 100 is arranged in the concave portion 51. As shown in FIG. 6, a cartridge side terminal group 132 which is formed of a plurality of terminals is arranged on the surface of the circuit board 100. In the present applied example, there are nine terminals in the cartridge side terminal group 132. In addition, the nine terminals have a rectangular shape. In addition, a storage device is arranged on the rear surface of the circuit board 100. The storage device stores information (for example, ink color) which relates to the cartridge 4. The cartridge side terminal group 132 and the storage device are electrically connected. Here, the concave portion 51 is provided in the position alignment member 40A.

A regulating surface 451 is provided in the corner where the front wall 42 and the second side wall 44 intersect. The regulating surface 451 is a surface which faces in the −Y axis direction (the insertion direction). When the cartridge 4 is mounted in the mounting section 6, the movement of the cartridge 4 in the −Y axis direction is regulated by the regulating surface 451 abutting against the regulating member 612 (FIG. 4).

A-4. Description of Mounted State

Figure 8:
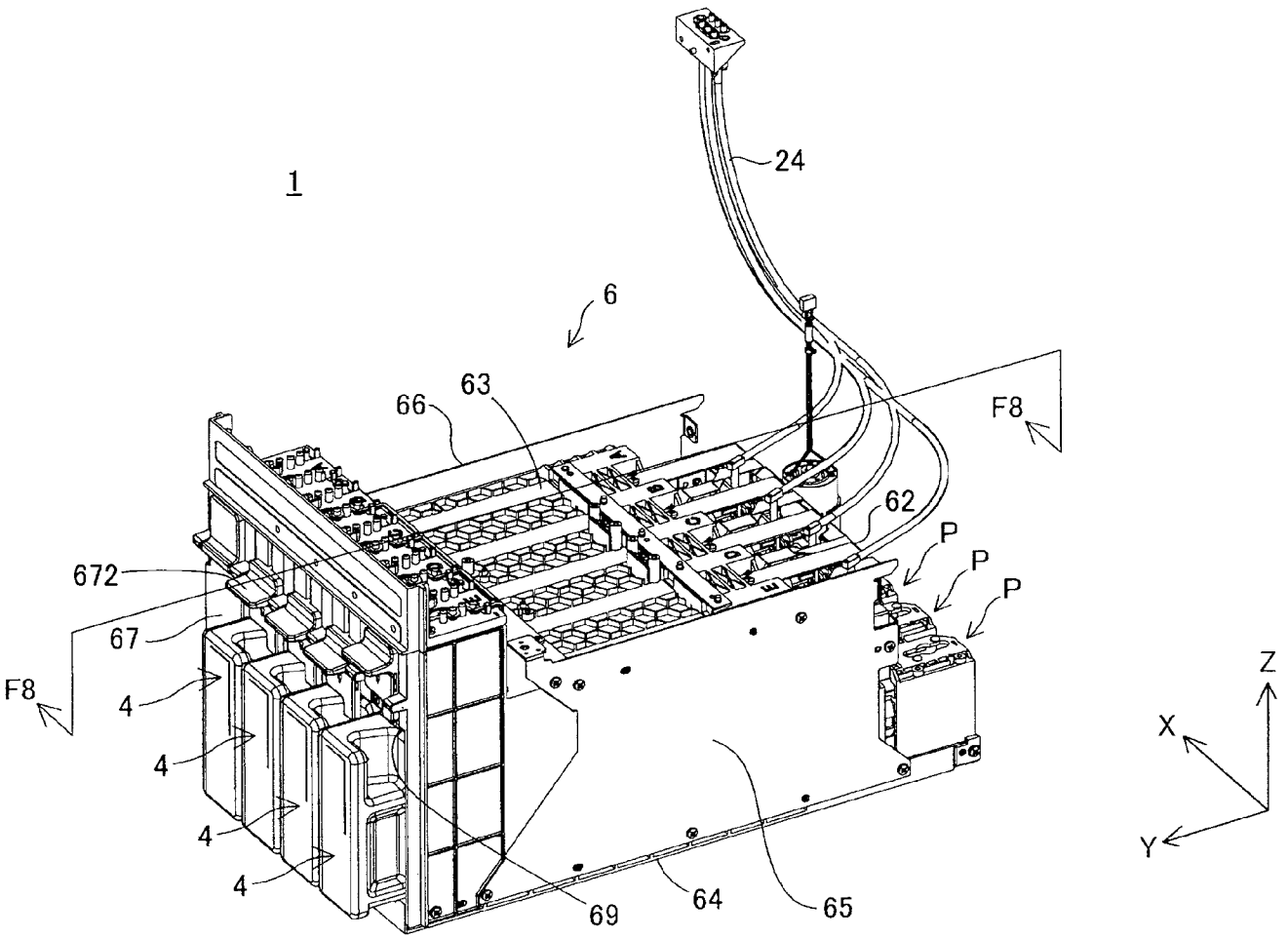
FIG. 8 is a perspective diagram of the external appearance when the cartridge 4 is mounted in the mounting section 6.
Figure 9:
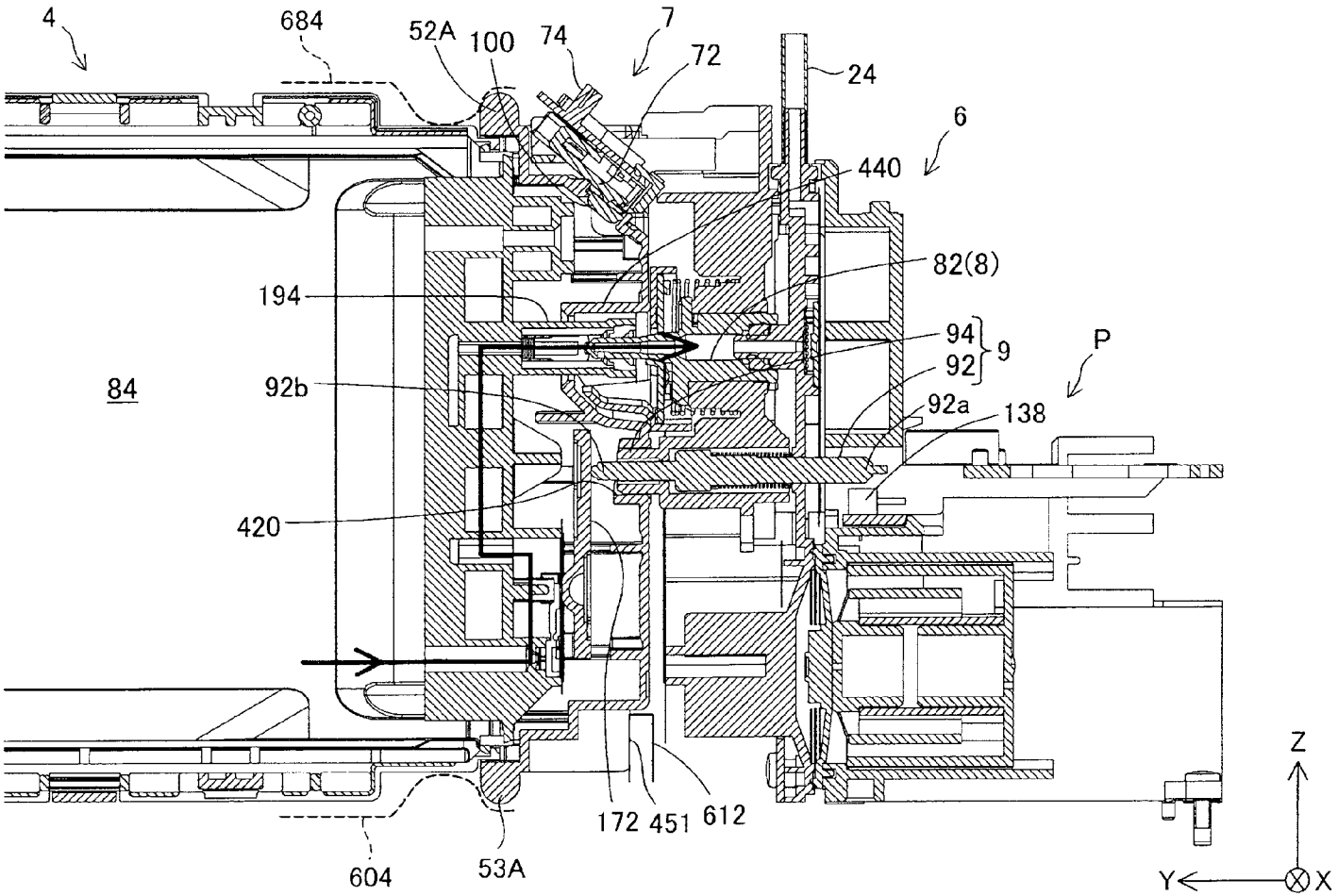
FIG. 9 is a partial cross sectional diagram of F8-F8 in FIG. 8.

Before describing the detailed configuration of the cartridge 4, the relationship between the mounting section 6 and the cartridge 4 in the mounted state will be described using FIG. 8 and FIG. 9. FIG. 8 is a perspective diagram of the external appearance when the cartridge 4 is mounted in the mounting section 6. FIG. 9 is a partial cross sectional diagram of F8-F8 in FIG. 8. Here, FIG. 9 shows the apparatus side front wall section 62 in the mounting section 6 and schematically illustrates the regulating member 612 and the leaf springs 684 and 604.

As shown in FIG. 8, in the mounted state, a portion of the cartridge 4 in the +Y axis direction side is exposed from the opening 69 and is mounted in the mounting section 6. As shown in FIG. 9, in the mounted state, the apparatus side terminal group 72 and the circuit board 100 are electrically connected. In addition, the liquid supplying needle 82 is inserted into the first insertion hole 440. In addition, the liquid supplying needle 82 is connected to a liquid supply port 194 for circulating the ink of the liquid accommodating section 84 to the outside. Here, "connected to the liquid supply port 194" refers to a state where it is possible for the ink of the liquid accommodating section 84 to circulate from the liquid supply port 194 to the printer 10 side. Here, the flow of the ink from the liquid accommodating section 84 to the liquid supplying needle 82 is schematically illustrated using an arrow.

In addition, in the mounted state, the rod member 9 is inserted into the second insertion hole 420. In addition, in the mounted state, a +Y axis direction side end portion 92*b* (which is also referred to as the "other end portion 92*b*") of the rod-shaped member 92 abuts against a moving member 172 of the cartridge 4. Here, the moving member 172 is a portion of the detection mechanism and the details will be described later. Here, the displacement of a −Y axis direction side end portion 92*a* (which is also referred to as the "one end portion 92*a*") of the rod-shaped member 92 is detected by an optical sensor 138 of the printer 10. Here, the sensor 138 is a portion of the detection mechanism and the details will be described below. In addition, in the mounted state, the regulating surface 451 abuts against the regulating member 612. In addition, in the mounted state, the leaf spring 684 presses the first A portion 52A to the −Y axis direction side and the leaf spring 604 presses the second A portion 53A to the −Y axis direction side.

In the mounted state, the movement of the cartridge 4 (in detail, the position alignment member 40A) is regulated by the mounting section 6 in three directions (the X axis direction, the Y axis direction, and the Z axis direction) which are parallel to three axes (the X axis, the Y axis, and the Z axis) which intersect with each other and include the attaching and detaching coordinate axis (Y axis). In detail, in the mounted state, the position alignment member 40A is positionally aligned with regard to the mounting section 6 by the mounting section 6 regulating the movement in the three directions of the X axis direction, the Y axis direction, and the Z axis direction. That is, in the mounted state, the movement of the position alignment member 40A in the X axis direction is regulated by the first A portion 52A being inserted in the first rail 682 (FIG. 3) and the second A portion 53A being inserted in the second rail 602 (FIG. 4). In addition, in the mounted state, the movement of the position alignment member 40A in the Y axis direction is regulated in the following manner. That is, the movement of the position alignment member 40A in the +Y axis direction is regulated by the first A portion 52A being pressed to the −Y axis direction side by the leaf spring 684 and the second A portion 53A being pressed to the −Y axis direction side by the leaf spring 604. In addition, the movement of the position alignment member 40A in the −Y axis direction is regulated by the regulating surface 451 abutting against the regulating member 612. In addition, in the mounted state, the movement of the position alignment member 40A in the Z axis direction is regulated by the rod member 9 being inserted into the second insertion hole 420.

A-5. First Detailed Configuration of Cartridge 4

Figure 10:
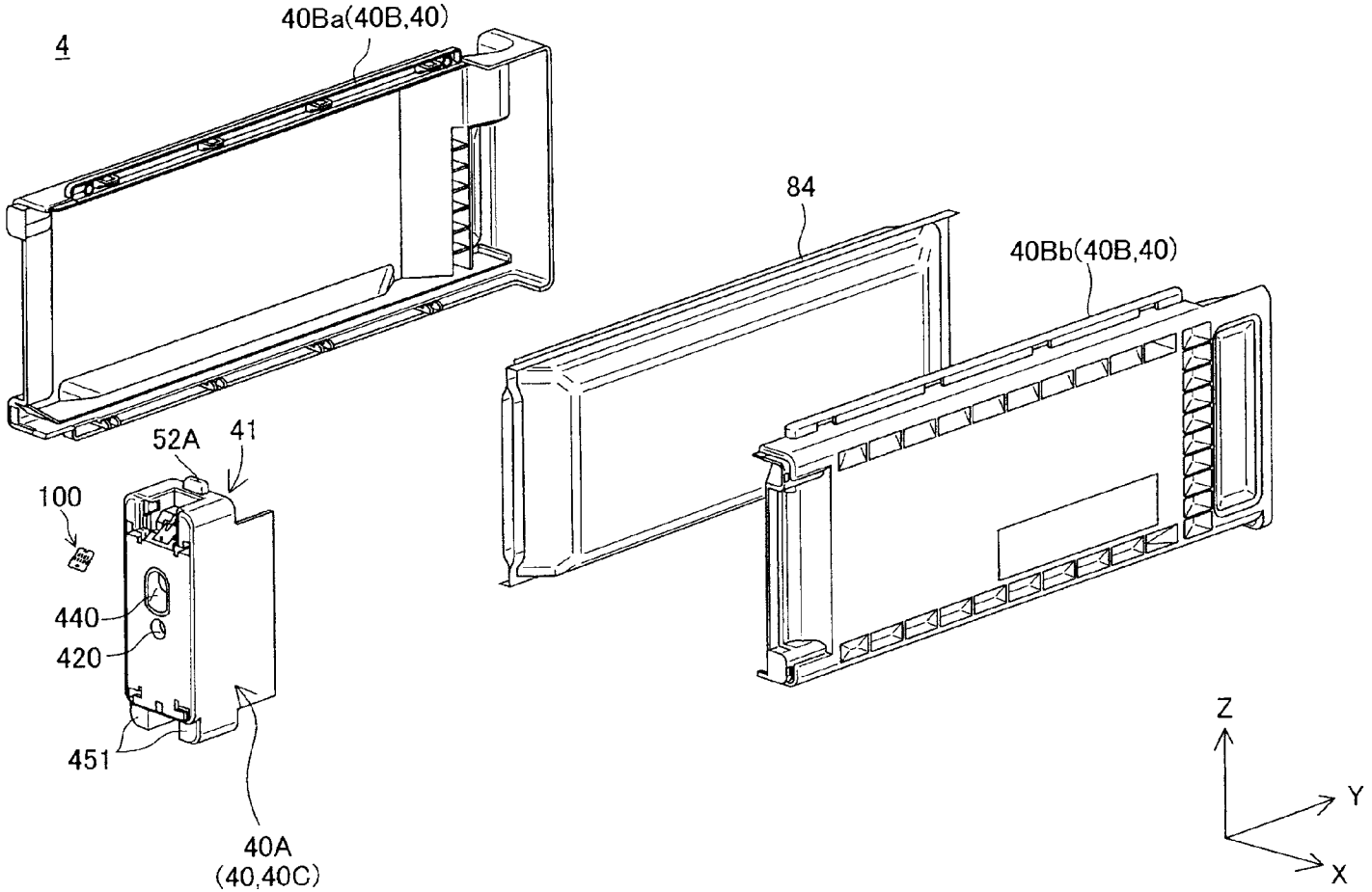
FIG. 10 is a first exploded perspective diagram of the cartridge 4.
Figure 11:
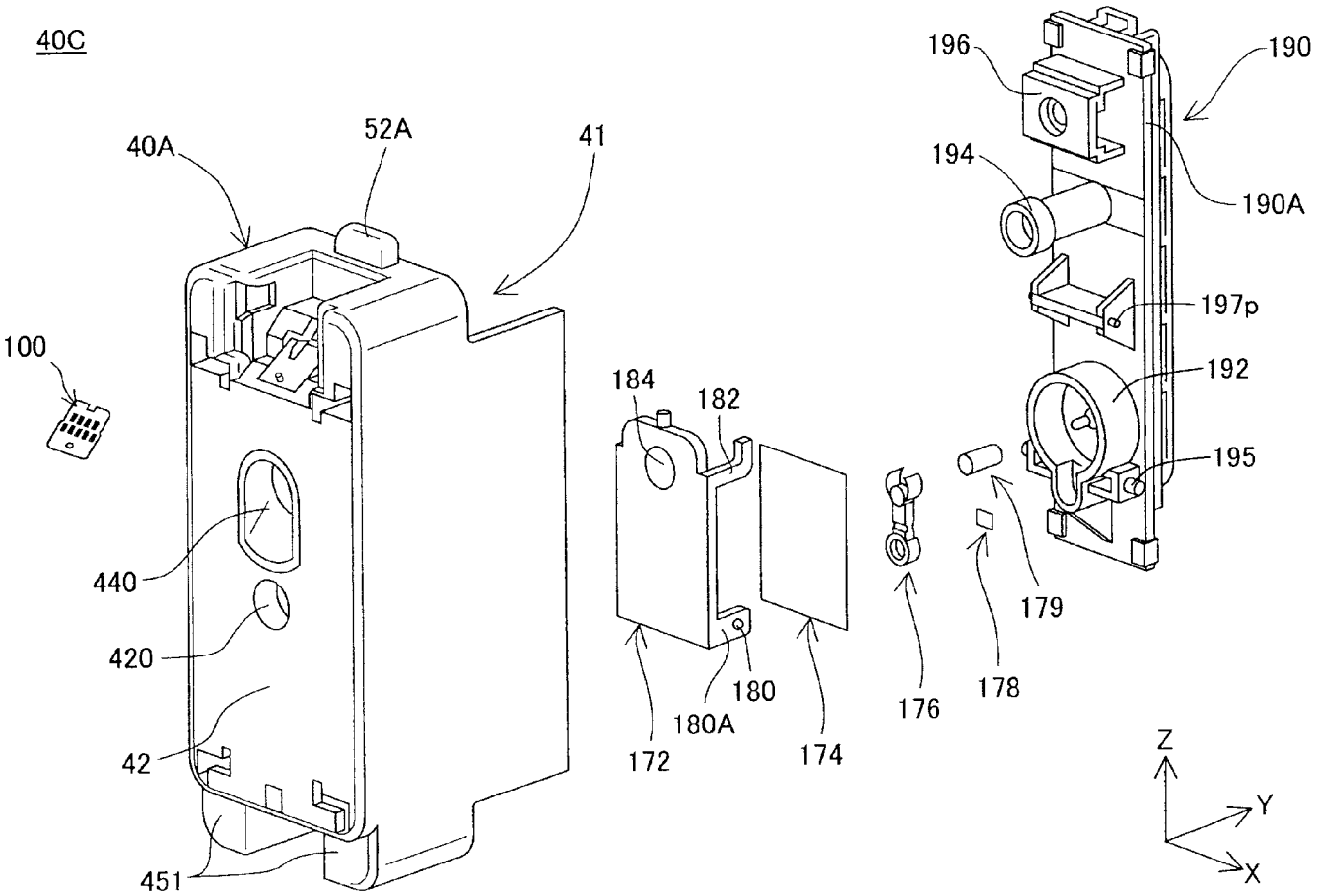
FIG. 11 is an exploded perspective diagram of a side portion of a mounting member 40C.
Figure 12:
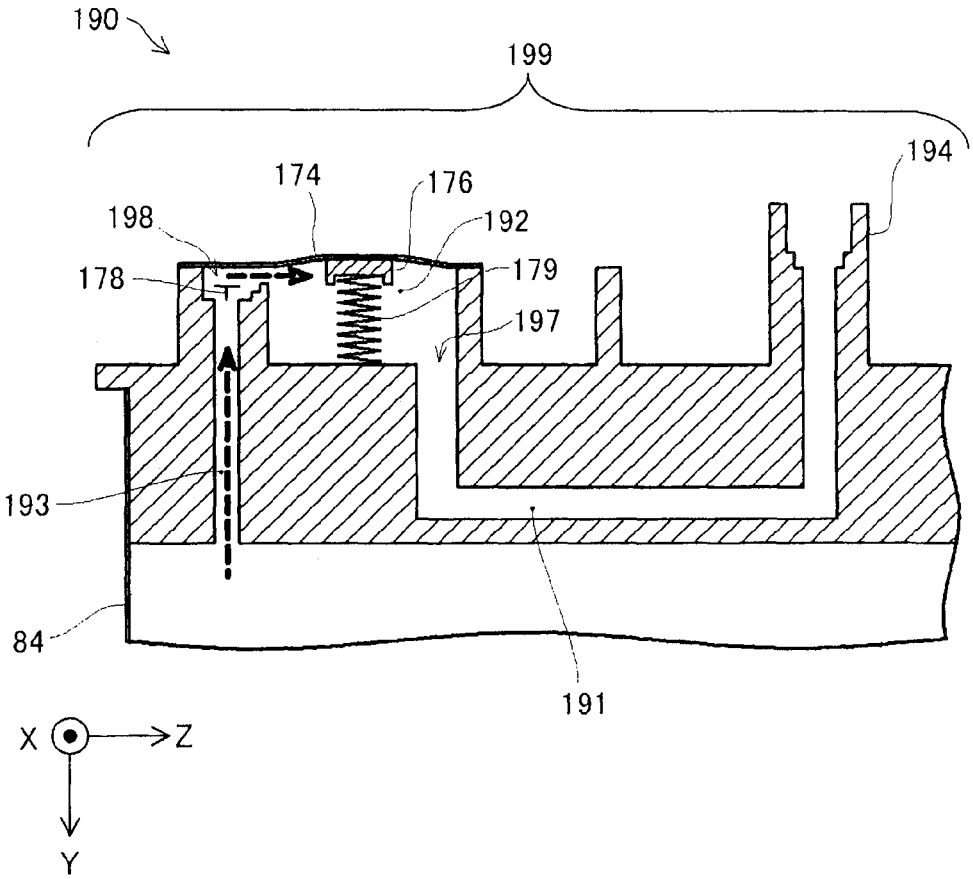
FIG. 12 is a first diagram for describing an inner portion flow path 199.
Figure 13:
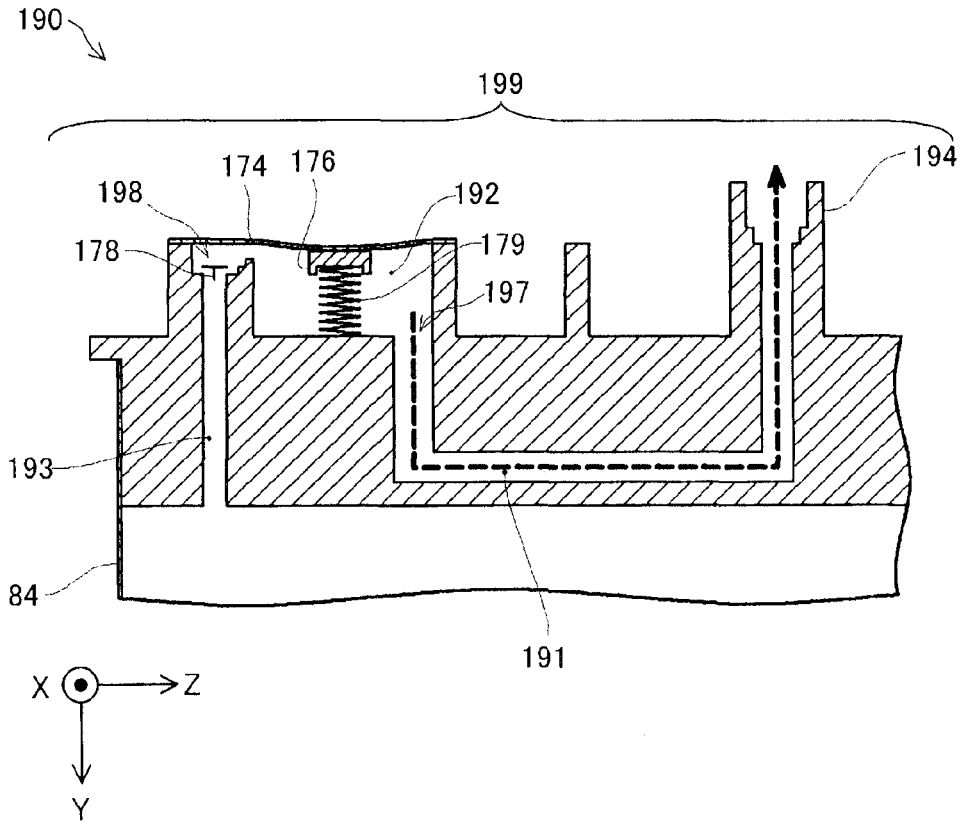
FIG. 13 is a second diagram for describing the inner portion flow path 199.

Next, the detailed configuration of the cartridge 4 will be described. FIG. 10 is a first exploded perspective diagram of the cartridge 4. FIG. 11 is an exploded perspective diagram of a side portion of the mounting member 40C. FIG. 12 is a first diagram for describing an inner portion flow path 199. FIG. 13 is a second diagram for describing the inner portion flow path 199. FIG. 12 and FIG. 13 schematically illustrate the inner portion flow path 199. In addition, FIG. 12 illustrates a situation when the suction pumps P are not being operated, and FIG. 13 illustrates a situation when the suction pumps P are being operated. Here, in FIG. 12 and FIG. 13, the moving member 172 is not shown in the diagram.

As shown in FIG. 10 and FIG. 11, the liquid accommodating section 84, the attachment member 190, and the moving member 172 are accommodated in the case 40 of the cartridge 4. Here, the liquid accommodating section 84 is accommodated in the protective member 40B as shown in FIG. 10. In addition, the attachment member 190 and the moving member 172 which is attached to the attachment member 190 are accommodated in the position alignment member 40A which configures a portion of the case 40 as shown in FIG. 11. The attachment member 190 is provided with an abutted member 190A with a plate shape which has a predetermined thickness in the Y axis direction. The movement of the attachment member 190 in the three directions is regulated by the abutted member 190A abutting against the position alignment member 40A. The position alignment member 40A has a box shape with one side opened. An opening 41 is formed at the +Y axis direction side. The first insertion hole 440 and the second insertion hole 420 are formed in a bottom portion 42 which is the front wall 42. The direction in which the bottom portion 42 and the opening 41 are opposed is the attaching and detaching direction (the Y axis direction). In addition, the direction from the bottom portion 42 toward the opening 41 is the +Y axis direction and the direction from the opening 41 toward the bottom portion 42 is the −Y axis direction.

The attachment member 190 forms the inner portion flow path 199 (FIG. 12 and FIG. 13) which links the liquid accommodating section 84 and the outside (the printer 10). The moving member 172 is provided at a position which faces the other end portion 92*b* of the rod-shaped member 92.

The protective member 40B as shown in FIG. 10 is formed by assembling a first protective member 40Ba and a second protective member 40Bb. The liquid accommodating section 84 is formed by, for example, an aluminum laminate multilayer film in which aluminum layers are laminated on a resin film layer. The liquid accommodating section 84 has flexibility and the volume thereof is reduced as the ink in the inner portion is reduced.

As shown in FIG. 12 and FIG. 13, in the flow direction in which the ink flows from the liquid accommodating section 84 to the printer 10 in the inner portion flow path 199, the upstream side is linked to the liquid accommodating section 84 and liquid supplying needle 82 is inserted in the downstream side. The downstream side portion (one end portion) is also referred to as the liquid supply port 194. The liquid supply port 194 has a substantially cylindrical shape.

As shown in FIG. 12, the inner portion flow path 199 has a liquid chamber 192 in the middle thereof. An inlet port 198 where the ink inside the liquid accommodating section 84 flows in and an outlet port 197 from which the ink flows out toward the liquid supply port 194 are opened in the liquid chamber 192. In addition, the liquid chamber 192 is formed by a film 174 in which the upper end surface which is the one side surface is formed by a flexible material. The volume of the liquid chamber 192 changes due to the film 174 changing shape in accompaniment with changes in the inner portion pressure. The film 174 corresponds to the "shape changing member" described in the Means for Solving the Problem.

A check valve 178 and a spring 179 are arranged inside the liquid chamber 192 as shown in FIG. 11 to FIG. 13. The check valve 178 prevents the ink which has flowed into the liquid chamber 192 from the inlet port 198 from flowing backward. The spring 179 presses the film 174 toward the outside of the liquid chamber 192. That is, the spring 179 presses the film 174 in a direction so that the volume of the liquid chamber 192 increases. In detail, the spring 179 is arranged in the liquid chamber 192 in a compressed state. In addition, a pressure plate 176 is inserted between the spring 179 and the film 174. The pressure plate 176 transmits the pressing force of the spring 179 to the film 174.

In addition, the moving member 172 comes into contact with the film 174, which configures the one end surface of the liquid chamber 192, from the outside of the liquid chamber 192. The moving member 172 is attached to the attachment member 190 so as to be able to be displaced with a predetermined fulcrum set as the center. As shown in FIG. 11, the moving member 172 has an attaching section 180A which is attached to the moving member 172 at the −Z axis direction side. The attaching section 180A has a shaft hole 180. The moving member 172 is supported on a shaft pin 195 so as to be able to rotate by the shaft hole 180 engaging with the shaft pin 195 which is provided on the outer surface of liquid chamber 192. On the other hand, as shown in FIG. 11, the moving member 172 is provided with a guide section 182 at the +Z axis direction side. The rotation operation of the moving member 172 is guided by the guide section 182 coming into contact with a guide pin 197*p* which is provided in the attachment member 190. A contact section 184 (which is also referred to as the "second contact section 184"), which abuts against the other end portion 92*b* of the rod-shaped member 92 in the mounted state, is formed in the moving member 172 on the surface of the opposite side to the surface which comes into contact with the film 174.

In addition, the attachment member 190 is provided with an inlet port 196. The inlet port 196 links the outside and the liquid accommodating section 84 and is used in order to inject the ink from the outside to the liquid accommodating section 84. Here, after the ink is filled into the liquid accommodating section 84, a linking flow path inside the inlet port 196 is closed off.

Using the attachment member 190 which is provided with such a configuration, the ink is supplied to the printer 10 from the liquid accommodating section 84 in the following manner.

When the suction pump P of the mounting section 6 as shown in FIG. 12 is not being operated, the spring 179 pushes out the film 174 such that the volume of the liquid chamber 192 increases. In accompaniment with the increase in the volume of the liquid chamber 192, the ink flows into the liquid chamber 192 through an inflow path 193 which links the liquid accommodating section 84 and the inlet port 198. Here, the dashed arrows in the drawing represent the flow of the ink.

When the suction pump P of the mounting section 6 is operated, ink is suctioned from the liquid supply port 194 and the ink inside the liquid chamber 192 is supplied to the mounting section 6 through an outflow path 191 which links the outlet port 197 and the liquid supply port 194. Then, in the ink cartridge 4 of the present applied example, since the inner diameter of the outflow path 191 is set to be larger than the inner diameter of the inflow path 193, the inflow amount of the ink to the liquid chamber 192 does not keep up with regard to the outflow amount of the ink from the liquid chamber 192, and there is negative pressure inside the liquid chamber 192. As a result, as shown in FIG. 13, against the force of the spring 179, the film 174 changes shape so as to be drawn to the inner side of the liquid chamber 192.

The negative pressure which is generated in the liquid chamber 192 is gradually relieved as the ink in the liquid accommodating section 84 flows into the liquid chamber 192 through the inflow path 193. In so doing, the film 174 is pushed out to the outside of the liquid chamber 192 again due to the force of the spring 179 and the volume of the liquid chamber 192 is restored. Due to this, after a predetermined time has passed since the suction pump P of the mounting section 6 stopped, there is a restoration of the state which is shown in FIG. 12. When the suction pump P of the mounting section 6 creates a differential again, there is negative pressure inside the liquid chamber 192 and the film 174 enters a state of being drawn to the inner side of the liquid chamber 192 as shown in FIG. 13. On the other hand, when the ink in the liquid accommodating section 84 is consumed and has run out, the ink no longer flows into the liquid chamber 192 even when there is negative pressure inside the liquid chamber 192. That is, after a predetermined time has passed since the operation of the suction pump P has stopped, the negative pressure inside the liquid chamber 192 is not relieved and the film 174 remains as it is in the state of being drawn to the inner side of the liquid chamber 192 as shown in FIG. 13.

In this manner, when the ink inside the liquid accommodating section 84 has run out, the film 174 of the liquid chamber 192 remains as it is in the state in which the shape is changed so as to be drawn to the inner side of the liquid chamber 192. That is, it is possible to detect a state where the ink has run out by detecting the displacement of the film 174. However, since the amount of displacement of the film 174 is small, the amount of displacement is amplified using the moving member 172 as follows.

Figure 14:
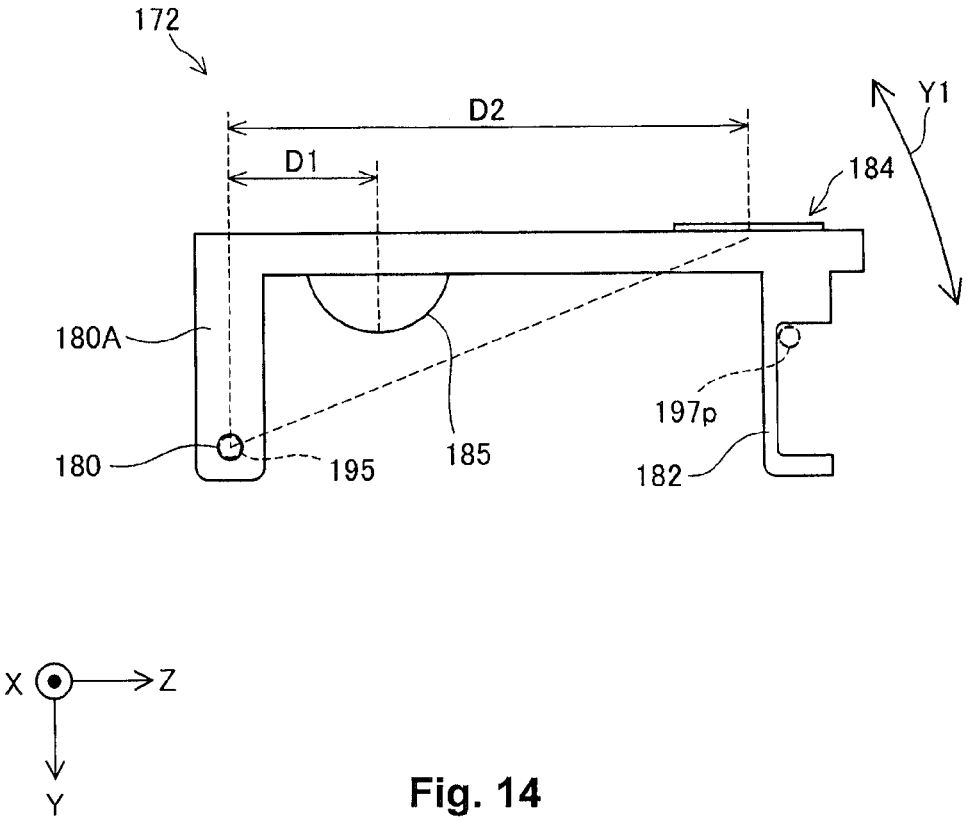
FIG. 14 is a diagram for describing a moving member 172.

FIG. 14 is a diagram for describing the moving member 172. The moving member 172 has a first contact section 185, a second contact section 184, and the attaching section 180A in which the shaft hole 180 is formed. The first contact section 185 is a convex portion with a semi-spherical shape and comes into contact with the film 174. The second contact section 184 comes into contact with the rod-shaped member 92 (FIG. 9). In addition, the second contact section 184 is a convex portion with a circular outer shape. The second contact section 184 is positioned at the side which is opposite to the shaft hole 180 with regard to the direction (the Z axis direction in the present applied example) which is orthogonal to the attaching and detaching direction (the Y direction) of the cartridge 4 so as to interpose the first contact section 185 therebetween. That is, a distance D2 from the shaft hole 180 which becomes the fulcrum of the moving member 172 to the second contact section 184 is larger than a distance D1 from the shaft hole 180 to the first contact section 185. Due to this, when the film 174 which is in contact with the first contact section 185 is displaced, the amount of displacement is amplified by the lever ratio R (=D2/D1>1, 3.1 in the present applied example) and is the displacement amount of the second contact section 184. Here, the second contact section 184 is displaced in the arrow Y1 direction with the shaft hole 180 as a fulcrum. The arrow Y1 direction is a direction which includes the components of the direction (the Y axis direction) which is along the attaching and detaching coordinate axis (the Y axis).

A-6. Method of Detecting State of Remaining Ink Amount

Figure 15:
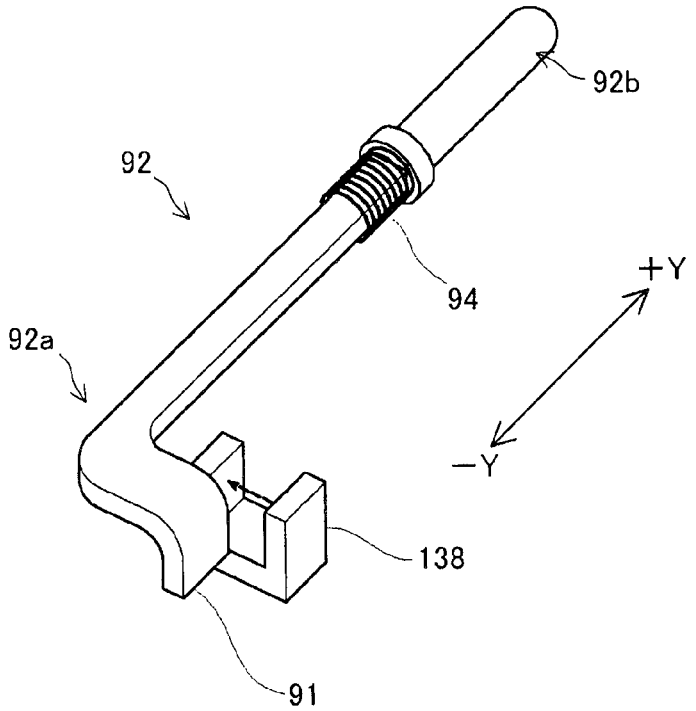
FIG. 15 is a schematic configurational diagram of a rod-shaped member 92 and a sensor 138 which are provided in the mounting section 6.

FIG. 15 is a schematic configurational diagram of the rod-shaped member 92 and the sensor 138 which are provided in the mounting section 6. As shown in FIG. 15, a spring 94 is attached to the rod-shaped member 92. The spring 94 presses the rod-shaped member 92 toward the cartridge 4 which is mounted in the mounting section 6.

The sensor 138 is a so-called transmission photo sensor with a concave shape. A light receiving section and a light emitting section which are not shown in the diagram are provided in the sensor 138 so as to oppose each other, and the light which is emitted by the light emitting section is set to be received by the light receiving section. Here, the dashed arrows in the drawing show the transmission direction of the light.

The one end portion 92*a* of the rod-shaped member 92 has a light blocking section 91. When the rod-shaped member 92 moves to the cartridge 4 side (the +Y axis direction side) due to the force of the spring 94, the light blocking section 91 is inserted between the light receiving section and the light emitting section of the sensor 138 and the light from the light emitting section is blocked. As a result, it is possible to detect the displacement of the one end portion 92*a* of the rod-shaped member 92 since the light from the light emitting section is no longer received in the light receiving section of the sensor 138. Here, the transmission photo sensor is used in the sensor 138 of the present applied example, but the invention is not limited to a photo sensor as long as it is possible to detect the displacement of the rod-shaped member 92.

Figure 16:
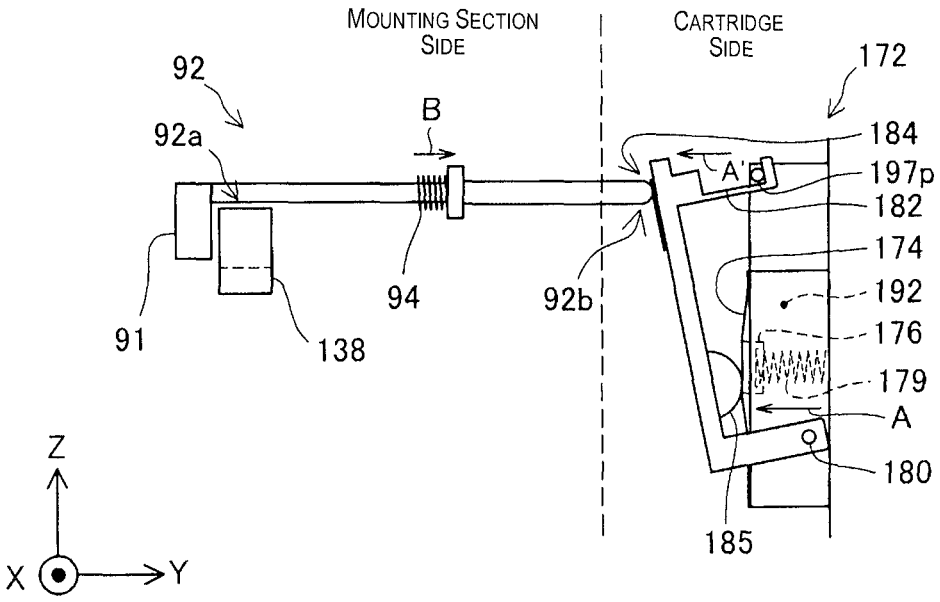
FIG. 16 is a first diagram for describing a method of detecting the state of the remaining amount of ink.
Figure 17:
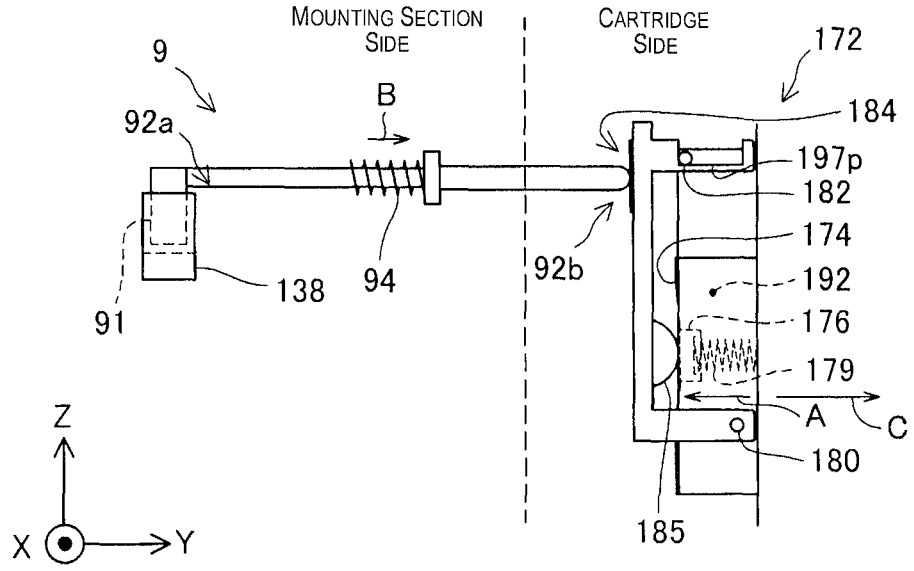
FIG. 17 is a second diagram for describing a method of detecting the state of the remaining amount of ink.

FIG. 16 is a first diagram for describing a method of detecting the state of the remaining amount of ink. FIG. 17 is a second diagram for describing a method of detecting the state of the remaining amount of ink. FIG. 16 is a diagram illustrating a state in which ink is sufficiently accommodated in the liquid accommodating section 84. FIG. 17 is a diagram illustrating a case where the ink of the liquid accommodating section 84 is a state where the ink has run out.

As shown in FIG. 16, when the cartridge 4 is mounted in the mounting section 6 in a state in which sufficient ink remains, the other end portion 92*b* of the rod-shaped member 92 abuts against the contact section 184 of the moving member 172 which is provided in the cartridge 4 side. Here, a pressing force A' which is applied to the contact section 184 of the moving member 172, which is due to a pressing force A of the spring 179 of the cartridge 4, is set so as to be larger than a pressing force B of the spring 94. Due to this, when the other end portion 92*b* of the rod-shaped member 92 abuts against the moving member 172, the rod-shaped member 92 moves to the back side (the −Y axis direction side) of the mounting section 6 against the pressing force B of the spring 94. In so doing, since the light blocking section 91 of the rod-shaped member 92 is separated from the sensor 138, the sensor 138 enters a state in which the light is transmitted. In this manner, it is possible for the sensor 138 to detect that the cartridge 4 is mounted on the mounting section 6 based on the change from the blocked state to the transmission state of the light due to the movement of the light blocking section 91 of the rod-shaped member 92. This state is maintained until the ink inside the liquid accommodating section 84 runs out or is running low. In this state, as long as there are no other abnormalities in the cartridge 4 or the printer 10, the printer 10 is controlled such that printing in possible. Here, since the techniques relating to the types of "other abnormalities" and the detection method thereof are well-known, description thereof will be omitted here.

As shown in FIG. 17, when the ink inside the liquid accommodating section 84 has run out (or is running low), the ink no longer flows into the liquid chamber 192 from the liquid accommodating section 84 and a negative pressure is exerted on the liquid chamber 192. Here, the pressing force A of the spring 179 of the cartridge 4 is set to be smaller than a force C due to the negative pressure which is generated in a case where the ink runs out in the liquid accommodating section 84 (or a case where the ink is running low). As such, due to the force C, the film 174 remains as it is in a state of being drawn to the inner side of the liquid chamber 192. When the film 174 changes shape in the direction such that the volume of the liquid chamber 192 decreases, the rod-shaped member 92 is displaced in the +Y axis direction by the pressing force B of the spring 94. In addition, in accompaniment with this displacement, the rod-shaped member 92 rotates the moving member 172 to follow the changing shape of the film 174, and the moving member 172 is held in a state of being closed. As a result, the rod-shaped member 92 is moved to the cartridge 4 side and the light blocking section 91 of the rod-shaped member 92 is inserted between the light emitting section and the light receiving section of the sensor 138. The sensor 138 detects that the ink inside the liquid accommodating section 84 has run out or is running low (the state where the ink has run out) based on the light being blocked by the light blocking section 91 of the rod-shaped member 92 (the rod-shaped member 92 being moved). Then, the printer 10 is controlled such that the printing is not possible in this state. Here, the force B with which the spring 94 presses the rod-shaped member 92 is amplified by the lever ratio R of the moving member 172. As such, when there is a transition from the state of FIG. 16 to the state of FIG. 17, it is possible to smoothly rotate the moving member 172 and it is possible to quickly detect the end of the ink even with a comparatively small force.

As described above, the liquid consumption system 1 detects the state of the remaining amount of ink using the moving member 172 which is provided in the cartridge 4, and the rod-shaped member 92 and the sensor 138 which are provided in the printer 10. As such, when the positional relationship of the moving member 172 and the rod-shaped member 92 deviates from the correct positional relationship which was set in advance, there are cases where detection precision of the state of the remaining amount of ink is reduced. As such, in the detection method where the state of the remaining amount of ink is detected using both of the members on the cartridge 4 side and the members on the printer 10 side together as in the present applied example, it is possible to suppress a reduction in detection precision of the state of the remaining amount of ink by arranging the space between the members which are used for detecting the state of the remaining amount of ink with the correct positional relationship.

Figure 18:
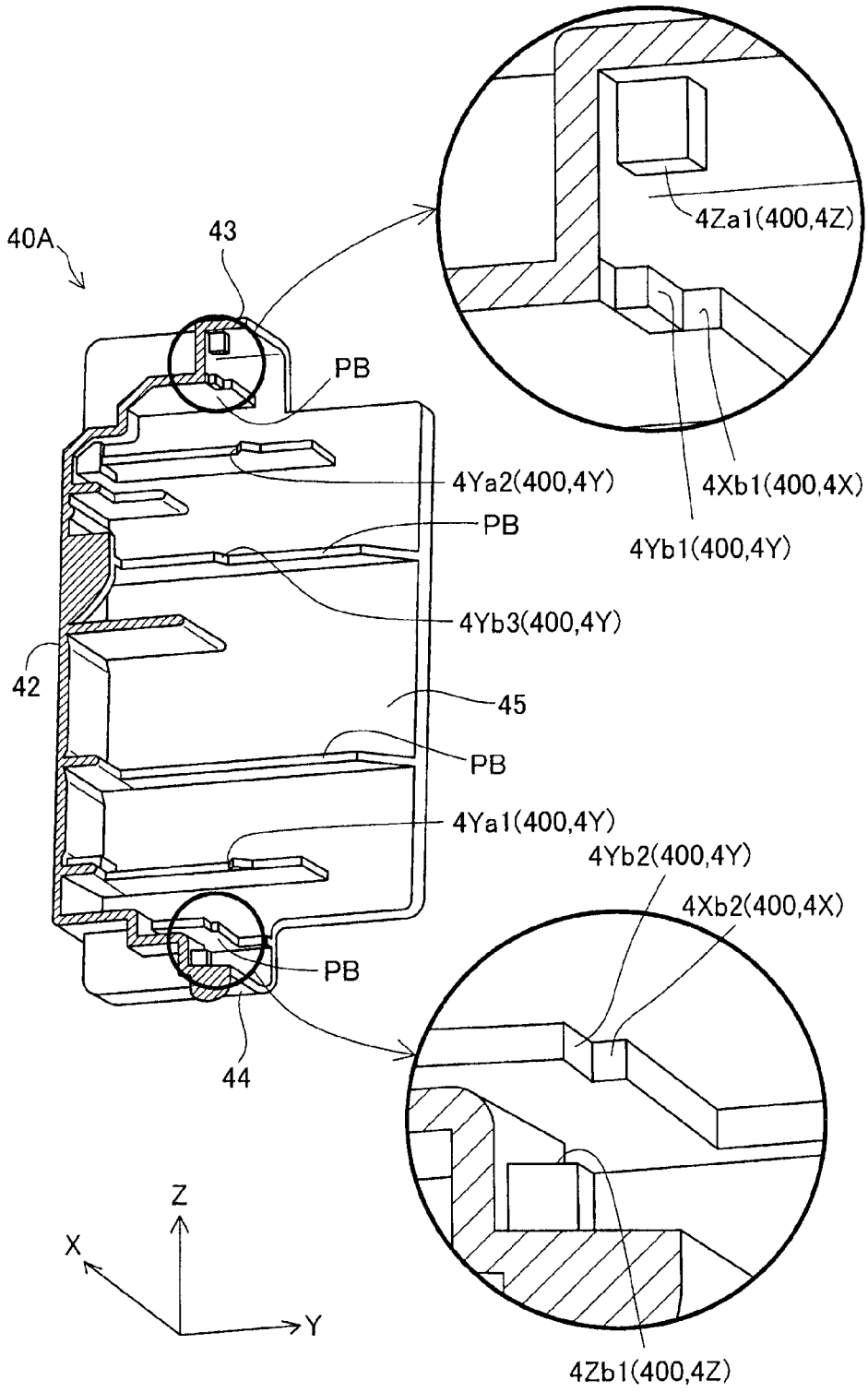
FIG. 18 is a perspective diagram in which a position alignment member 40A is cut along a plane which is parallel to the Y axis and the Z axis.
Figure 19:
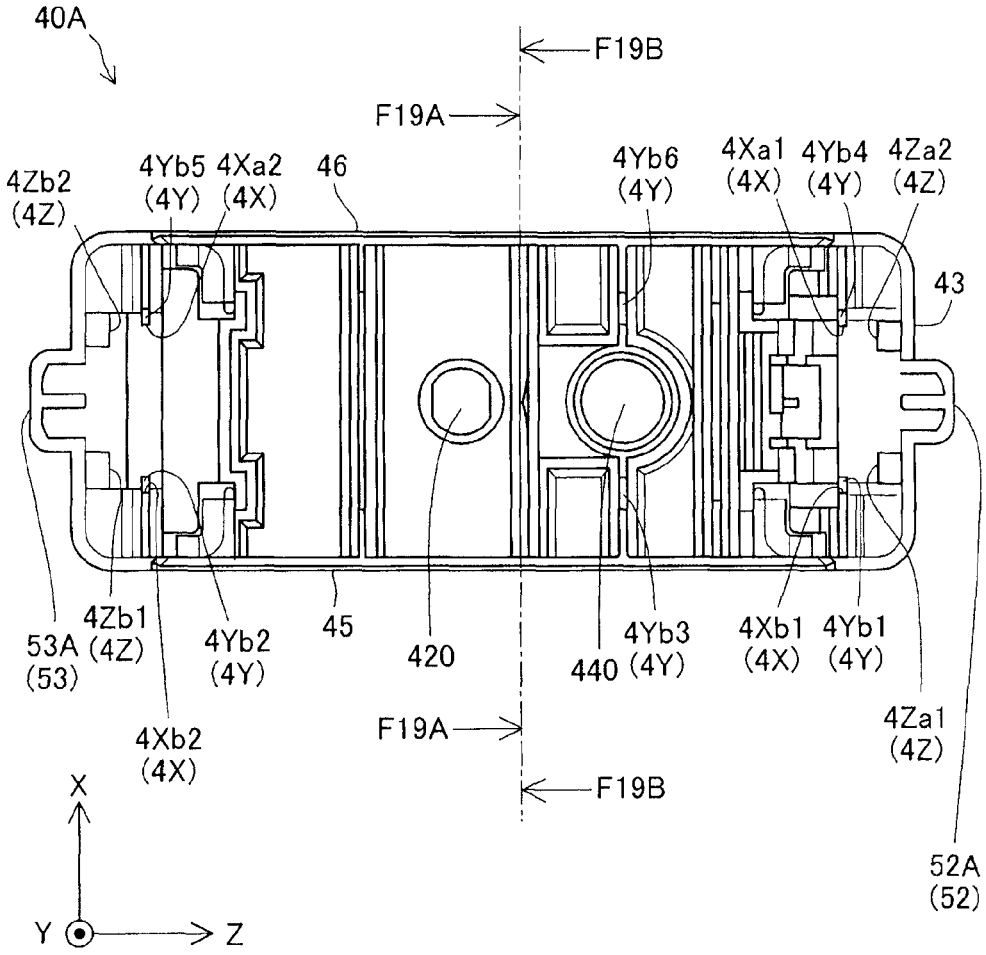
FIG. 19 is a rear surface diagram of the position alignment member 40A.
Figure 20:
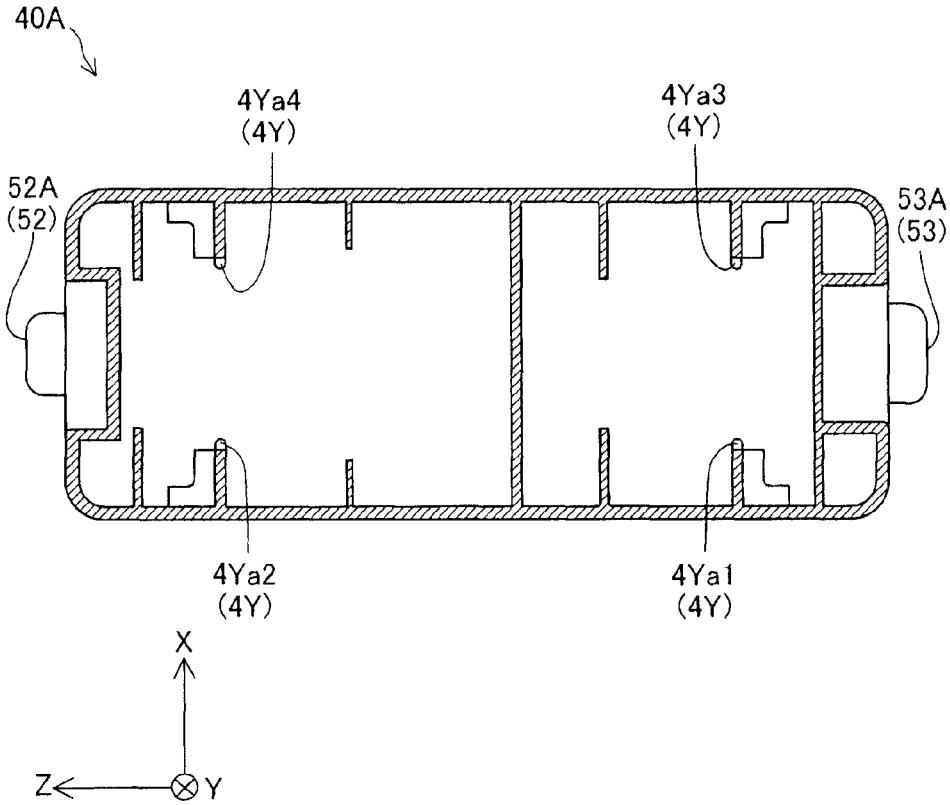
FIG. 20 is a diagram in which the position alignment member 40A is cut along a plane which is parallel to the X axis and the Z axis.
Figure 21:
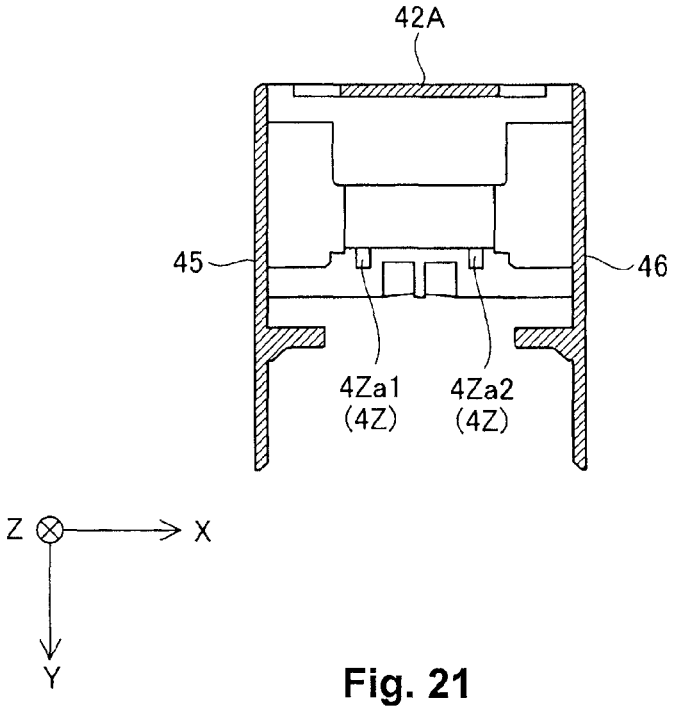
FIG. 21 is a cross sectional diagram of F19A-F19A in FIG. 19.
Figure 22:
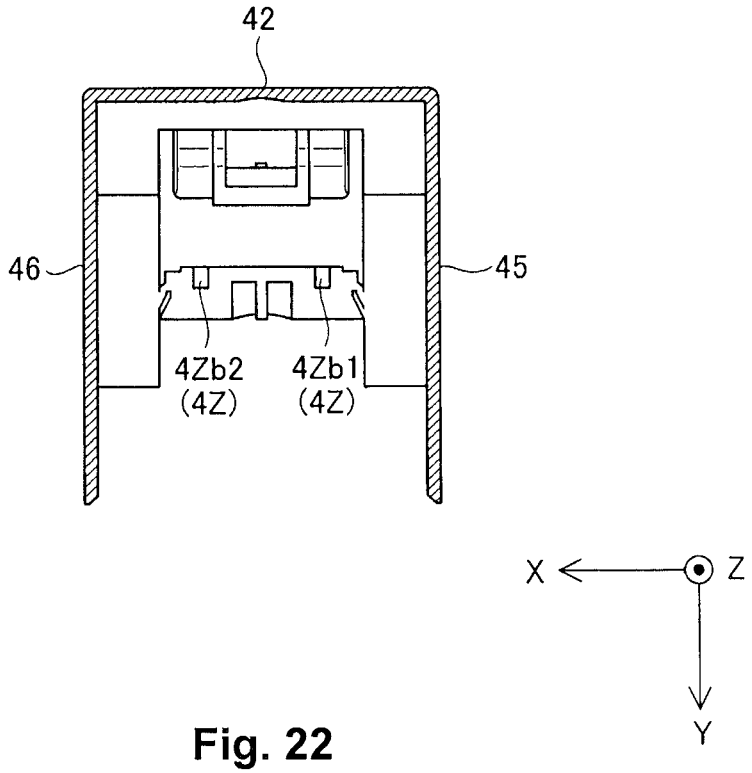
FIG. 22 is a cross sectional diagram of F19B-F19B in FIG. 19.

A-7. Description of Positional Alignment of Attachment Member 190 Using Position Alignment Member Next, the detailed configuration of the position alignment member 40A will be described using FIG. 18 to FIG. 22. FIG. 18 is a perspective diagram in which the position alignment member 40A is cut along a plane which is parallel to the Y axis and the Z axis. FIG. 19 is a rear surface diagram of the position alignment member 40A. FIG. 20 is a diagram in which the position alignment member 40A is cut along a plane which is parallel to the X axis and the Z axis. FIG. 21 is a cross sectional diagram of F19A-F19A in FIG. 19. FIG. 22 is a cross sectional diagram of F19B-F19B in FIG. 19.

As shown in FIG. 18, a plurality of protruding members PB are formed in the inner wall of the position alignment member 40A. A plurality of sets of regulating sections 400 which perform positional alignment of the attachment member 190 in three directions (the X axis direction, the Y axis direction, and the Z axis direction) are formed using a portion of the plurality of protruding members PB. Here, in the plurality of sets of regulating sections 400, a member, which performs positional alignment with regard to the position alignment member 40A by regulating the movement of the attachment member 190 in the X axis direction, is also referred to as a first regulating section 4X. In addition, in the plurality of sets of regulating sections 400, a member, which performs positional alignment with regard to the position alignment member 40A by regulating the movement of the attachment member 190 in the Y axis direction, is also referred to as a second regulating section 4Y. In addition, in the plurality of sets of regulating sections 400, a member which is positionally aligned with regard to the position alignment member 40A by regulating the movement of the attachment member 190 in the Z axis direction is also referred to as a third regulating section 4Z.

As shown in FIG. 18 and FIG. 19, the first regulating section 4X is provided with +X axis abutting sections 4Xa1 and 4Xa2, which abut against the attachment member 190 and which regulate the movement in the +X axis direction, and −X axis abutting sections 4Xb1 and 4Xb2, which abut against the attachment member 190 and which regulate the movement in the −X axis direction. The +X axis abutting sections 4Xa1 and 4Xa2 and the −X axis abutting sections 4Xb1 and 4Xb2 are provided in pairs.

As shown in FIG. 18 to FIG. 20, the second regulating section 4Y is provided with +Y axis abutting sections 4Ya1, 4Ya2, 4Ya3, and 4Ya4 (FIG. 20), which abut against the attachment member 190 and which regulate the movement in the +Y axis direction, and −Y axis abutting sections 4Yb1, 4Yb2, 4Yb3, 4Yb4, 4Yb5, and 4Yb6 (FIG. 18 and FIG. 19), which abut against the attachment member 190 and which regulate the movement in the −Y axis direction. Four of the Y axis abutting sections 4Ya1, 4Ya2, 4Ya3 and 4Ya4 and six of the −Y axis abutting sections 4Yb1, 4Yb2, 4Yb3, 4Yb4, 4Yb5, and 4Yb6 are provided.

As shown in FIG. 18, FIG. 19, FIG. 21, and FIG. 22, the third regulating section 4Z is provided with +Z axis abutting sections 4Za1 and 4Za2, which abut against the attachment member 190 and which regulate the movement in the +Z axis direction, and −Z axis abutting sections 4Zb1 and 4Zb2, which abut against the attachment member 190 and which regulate the movement in the −Z axis direction. The +Z axis abutting sections 4Za1 and 4Za2 and the −Z axis abutting sections 4Zb1 and 4Zb2 are provided in pairs.

Each of the abutting sections 4Xa1, 4Xa2, 4Xb1, 4Xb2, 4Ya1 to 4Ya4, 4Yb1 to 4Yb6, 4Za1, 4Za2, 4Zb1, and 4Zb2 is formed by a surface which is different to the inner wall surface of the position alignment member 40A.

Figure 23:
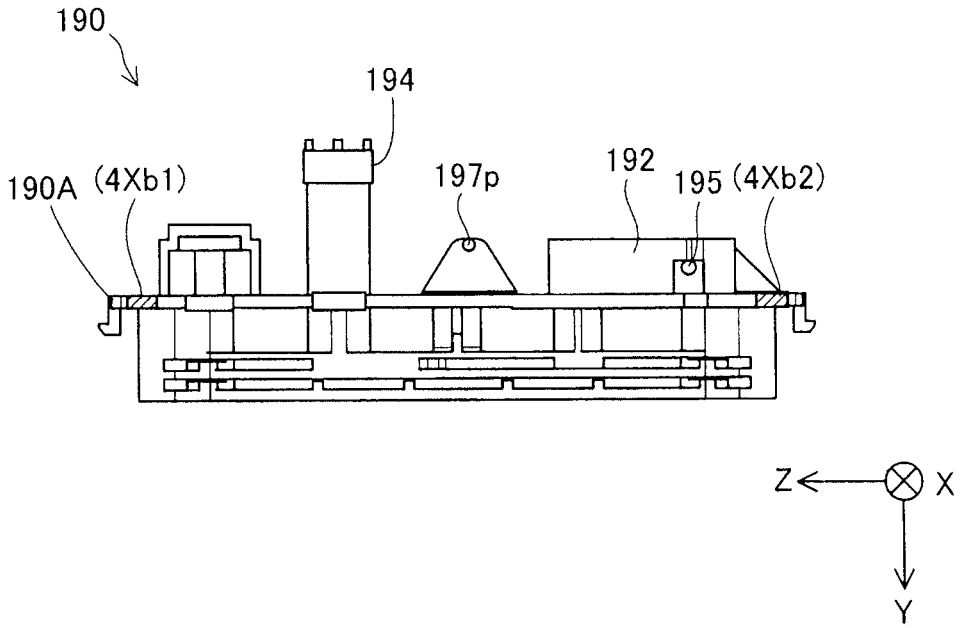
FIG. 23 is a first diagram illustrating an attachment member 190.
Figure 24:
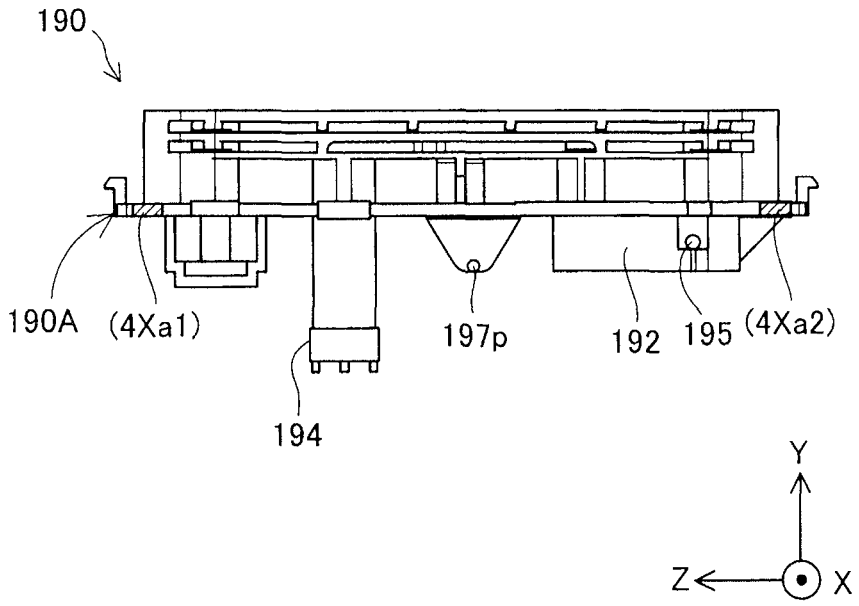
FIG. 24 is a second diagram illustrating the attachment member 190.
Figure 25:
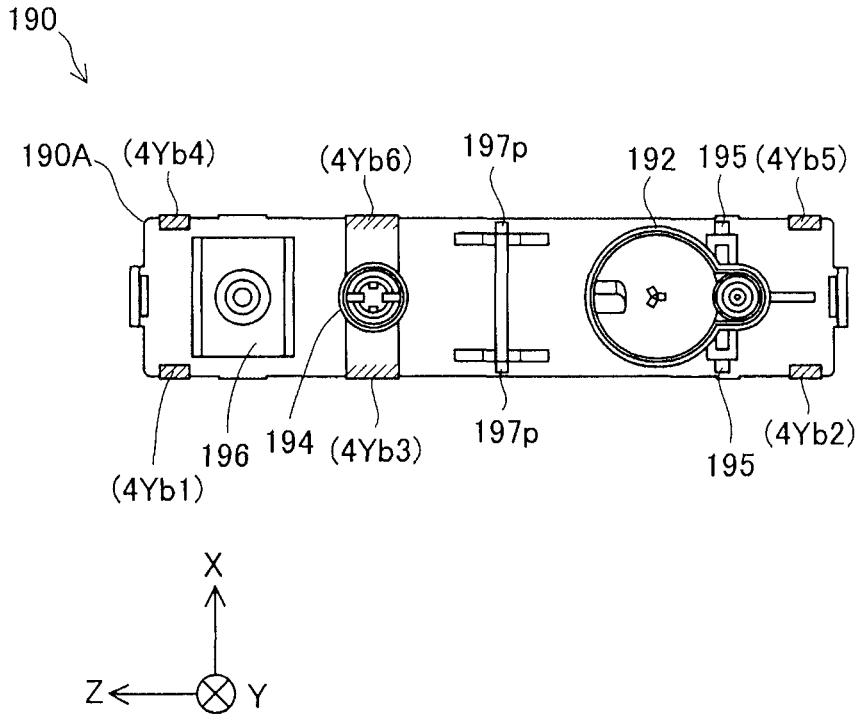
FIG. 25 is a third diagram illustrating the attachment member 190.
Figure 26:
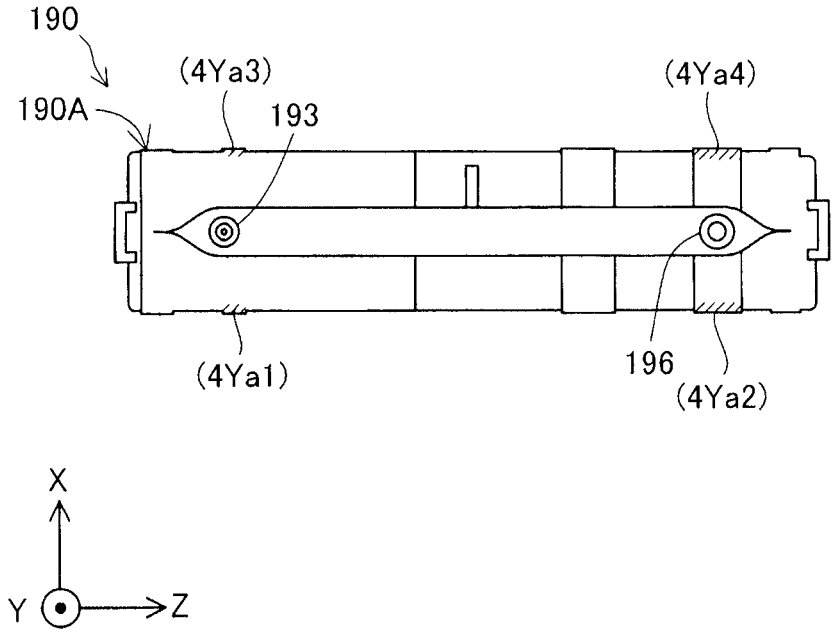
FIG. 26 is a fourth diagram illustrating the attachment member 190.
Figure 27:
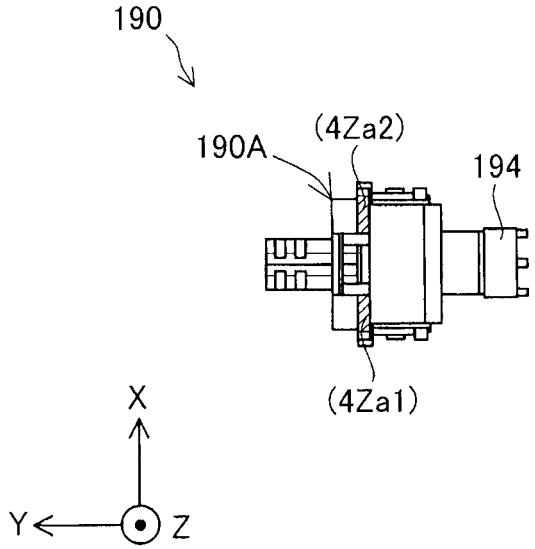
FIG. 27 is a fifth diagram illustrating the attachment member 190.
Figure 28:
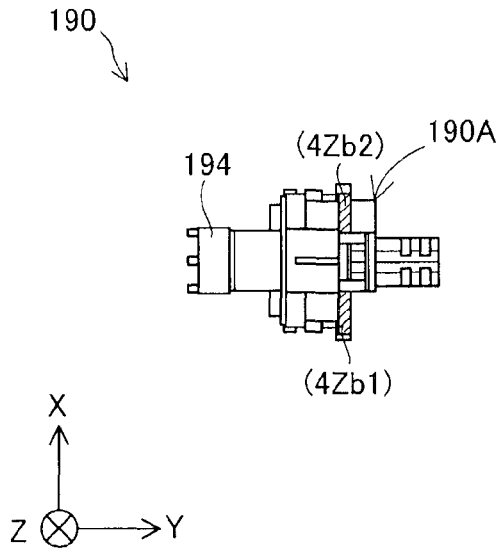
FIG. 28 is a sixth diagram illustrating the attachment member 190.

FIG. 23 is a first diagram illustrating the attachment member 190. FIG. 24 is a second diagram illustrating the attachment member 190. FIG. 25 is a third diagram illustrating the attachment member 190. FIG. 26 is a fourth diagram illustrating the attachment member 190. FIG. 27 is a fifth diagram illustrating the attachment member 190. FIG. 28 is a sixth diagram illustrating the attachment member 190. In FIG. 23 to FIG. 28, when the attachment member 190 is accommodated in the position alignment member 40A, hatching is applied to the portions which come into contact with each of the abutting sections 4Xa1, 4Xa2, 4Xb1, 4Xb2, 4Ya1 to 4Ya4, 4Yb1 to 4Yb6, 4Za1, 4Za2, 4Zb1, and 4Zb2 of the position alignment member and the reference numerals of each of the abutting sections are added in brackets.

As shown in FIG. 23 to FIG. 28, positional alignment of the attachment member 190 in three directions (the X axis direction, the Y axis direction, and the Z axis direction) is performed with regard to the position alignment member 40A by abutting against the abutting sections 4Xa1, 4Xa2, 4Xb1, 4Xb2, 4Ya1 to 4Ya4, 4Yb1 to 4Yb6, 4Za1, 4Za2, 4Zb1, and 4Zb2 which correspond to the surface of the abutted member 190A of the position alignment member 40A.

Figure 29:
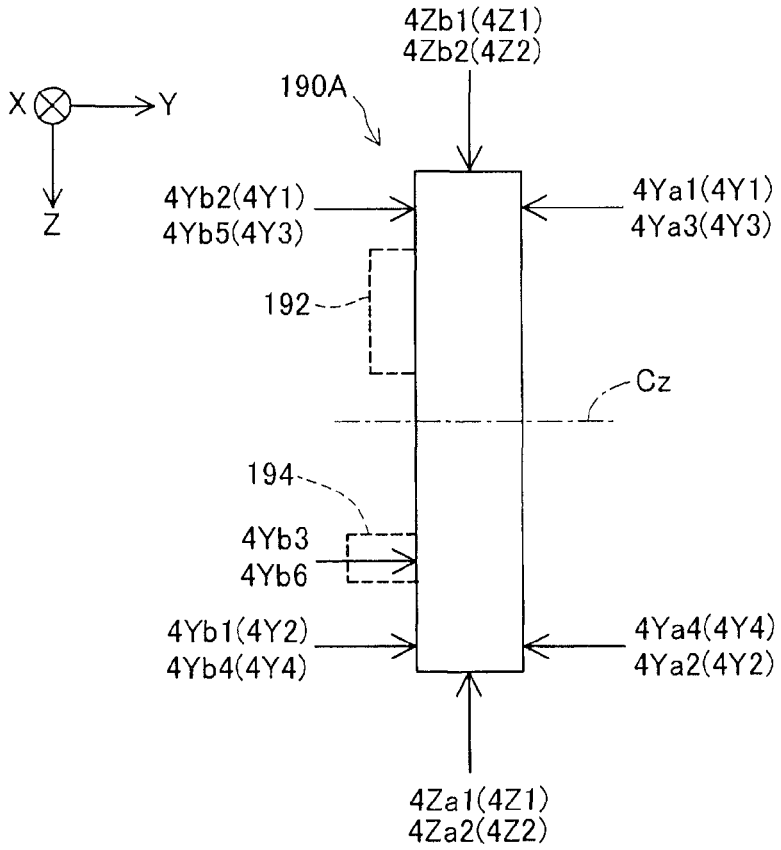
FIG. 29 is a first diagram illustrating a relationship between each of the abutting sections and an abutted member 190A.
Figure 30:
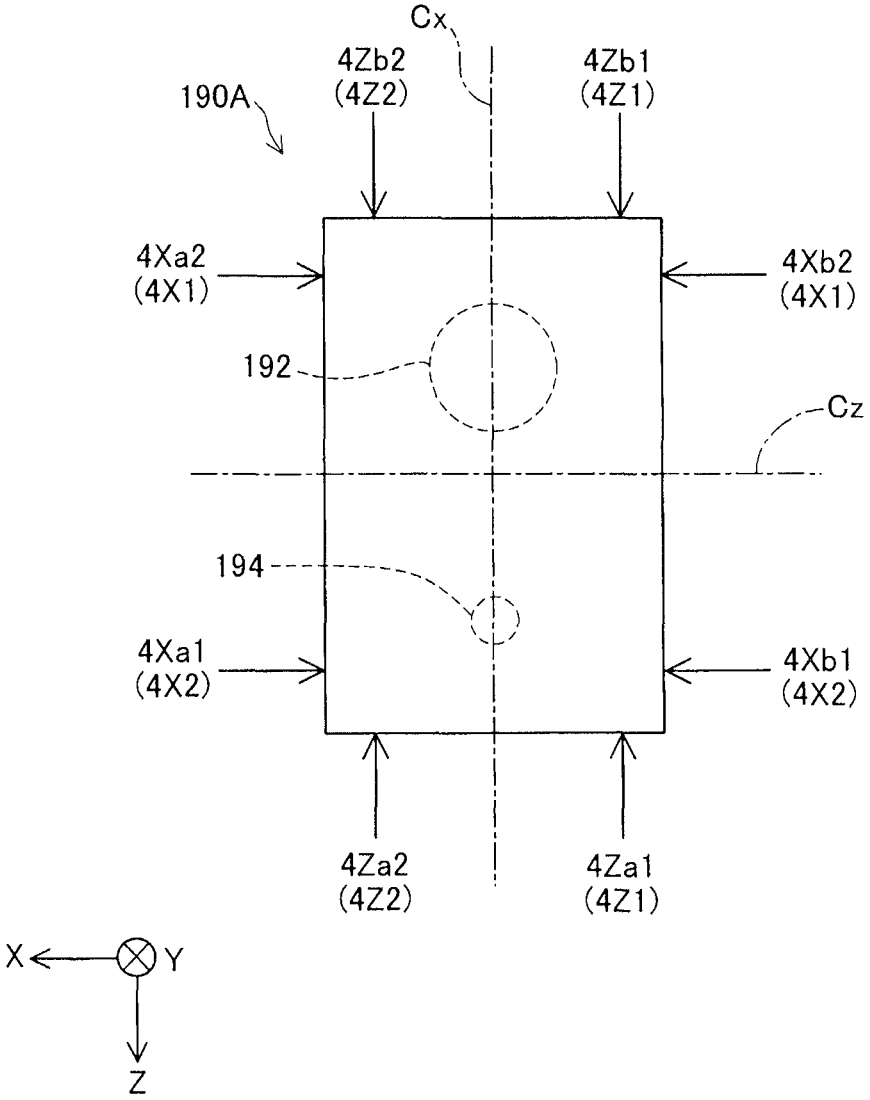
FIG. 30 is a second diagram illustrating the relationship between each of the abutting sections and the abutted member 190A.
Figure 31:
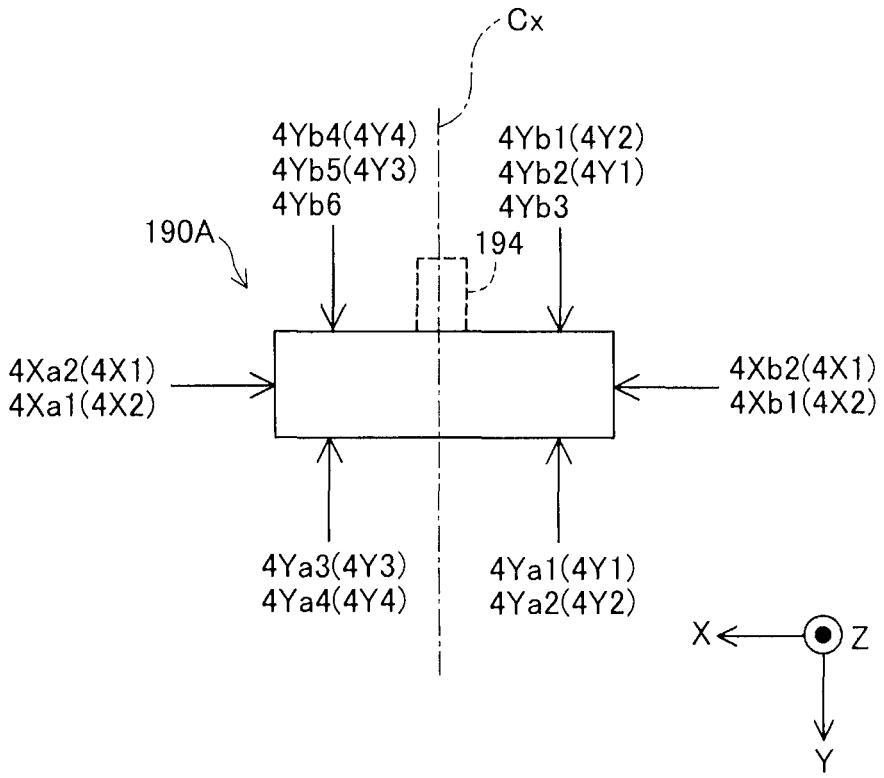
FIG. 31 is a third diagram illustrating the relationship between each of the abutting sections and the abutted member 190A.

FIG. 29 is a first diagram illustrating a relationship between each of the abutting sections and the abutted member 190A. FIG. 30 is a second diagram illustrating the relationship between each of the abutting sections and the abutted member 190A. FIG. 31 is a third diagram illustrating the relationship between each of the abutting sections and the abutted member 190A. In FIG. 29 to FIG. 31, each of the abutting sections which abut against the abutted member 190A is represented by arrows and the reference numerals of each of the abutting sections.

Here, a pair of a +X axis abutting section and a −X axis abutting section is necessary in order to regulate the movement of the attachment member 190 in the X axis direction. In addition, in the same manner, a pair of a +Y axis abutting section and a −Y axis abutting section is necessary in order to regulate the movement of the attachment member 190 in the Y axis direction. In addition, in the same manner, a pair of a +Z axis abutting section and a −Z axis abutting section is necessary in order to regulate the movement of the attachment member 190 in the Z axis direction. The pair of the +X axis abutting section and the −X axis abutting section is also referred to as the "X axis regulating sections", the pair of the +Y axis abutting section and the −Y axis abutting section is also referred to as the "Y axis regulating sections", and the pair of the +Z axis abutting section and the −Z axis abutting section is also referred to as the "Z axis regulating sections". In the present applied example, the reference numerals "4X1" and "4X2" are attached to the X axis regulating sections, the reference numerals "4Y1 to 4Y4" are attached to the Y axis regulating sections, and the reference numerals "4Z1" and "4Z2" are attached to the Z axis regulating sections.

As shown in FIG. 30, the X axis regulating sections 4X1 and 4X2 are at positions which sandwich a center line Cz of the length of the abutted member 190A in the Z axis direction. As shown in FIG. 29 and FIG. 31, the Y axis regulating sections 4Y1 to 4Y4 are at positions which sandwich a center line Cx of the abutted member 190A in the length of the X axis direction and the center line Cz of the length of the abutted member 190A in the Z axis direction. As shown in FIG. 30, the Z axis regulating sections 4Z1 and 4Z2 are at positions which sandwich the center line Cx of the length of the abutted member 190A in the X axis direction.

A-8. Effect

In the present applied example as described above, the position alignment member 40A is positionally aligned in the mounted state by the movement in the three directions of the X axis direction, the Y axis direction, and the Z axis direction being regulated using the mounting section 6. In addition, the attachment member 190, which is attached to the moving member 172 which is used for detecting the state of the remaining amount of ink, is positionally aligned by the movement in the three directions being regulated by the position alignment member 40A. Due to this, in the mounted state, it is possible to reduce the possibility that the positional relationship of the moving member 172 and the rod-shaped member 92, which is used to detect the state of the remaining amount of ink, of the mounting section 6 will deviate from the correct positional relationship. As such, it is possible to suppress a reduction in detection precision of the state of the remaining amount of ink using the moving member 172, the rod-shaped member 92, and the sensor 138.

In addition, in the applied example described above, protruding members PB are provided (FIG. 18) in the inner wall of the position alignment member 40A and it is possible to easily form a plurality of sets of regulating sections 4X, 4Y, and 4Z using a portion of the protruding members PB.

In addition, in the applied example described above, the number of the +Y axis abutting sections 4Ya1, 4Ya2, 4Ya3, and 4Ya4 is smaller (FIGS. 18, 19, and 20) than the number of −Y axis abutting sections 4Yb1, 4Yb2, 4Yb3, 4Yb4, 4Yb5, and 4Yb6 which are positioned more to the −Y axis direction side than the +Y axis abutting sections 4Ya1, 4Ya2, 4Ya3, and 4Ya4. Due to this, when the attachment member 190 is assembled with the position alignment member 40A from the opening 41 (FIG. 11) of the position alignment member 40A, it is possible to reduce frictional resistance between the +Y axis abutting sections 4Ya1, 4Ya2, 4Ya3, and 4Ya4 and the attachment member 190. Due to this, it is possible to easily assemble the attachment member 190 with the position alignment member 40A.

In addition, in applied example described above, the X axis regulating sections 4X1 and 4X2 are at positions (FIG. 30) which sandwich the center line Cz of the length of the abutted member 190A in the Z axis direction, the Y axis regulating sections 4Y1 to 4Y4 are at positions (FIGS. 29 and 31) which sandwich the center line Cx of the length of the abutted member 190A in the X axis direction and the center line Cz of the length of the abutted member 190A in the Z axis direction, and the Z axis regulating sections 4Z1 and 4Z2 are at positions (FIG. 30) which sandwich the center line Cx of the length of the abutted member 190A in the X axis direction. Due to this, it is possible to further suppress deviations in the position of the attachment member 190 with regard to the position alignment member 40A even in a case where the abutted member 190A has a plate shape which has a thickness in the Z axis direction and predetermined dimensions in the X axis direction and the Y axis direction.

In addition, in the applied example described above, the protective member 40B which accommodates the liquid accommodating section 84 is assembled with the position alignment member 40A such that micro-movement is possible. Due to this, it is possible to suppress inclining of the position alignment member 40A by configuring the protective member 40B so as to move slightly with regard to the position alignment member 40A to the extent of the clearance between the protective member 40B and the position alignment member 40A even in a case where the protective member 40B is inclined with regard to the horizontal direction. That is, it is possible for the position alignment member 40A to maintain the correct posture and it is possible to reduce the possibility that the positional relationship of the moving member 172 and the rod-shaped member 92 will deviate from the correct positional relationship. As such, it is possible to further suppress a reduction in precision of the detection of the remaining amount of ink.

B. Modified Examples

Above, an applied example of the present invention has been described, but the present invention is not limited to such an applied example and it is possible for the present invention to adopt various configurations within a range which does not depart from the gist thereof. For example, the following modifications are possible.

B-1. First Modified Example

In the applied example described above, the carriage 4 which is provided with the protective member 40B which accommodates the liquid accommodating section 84 which is the liquid supply source and the mounting member 40C have been described (FIG. 10 and FIG. 11), but it is not necessary for the liquid supply source to be integrated with the carriage 4 which is attached to and detached from the mounting section 6. For example, ink may be supplied to the printer 10 through the mounting member 40C using an external liquid retaining body which is a liquid supply source which is arranged outside of the mounting member 40C and the printer 10.

Figure 32:
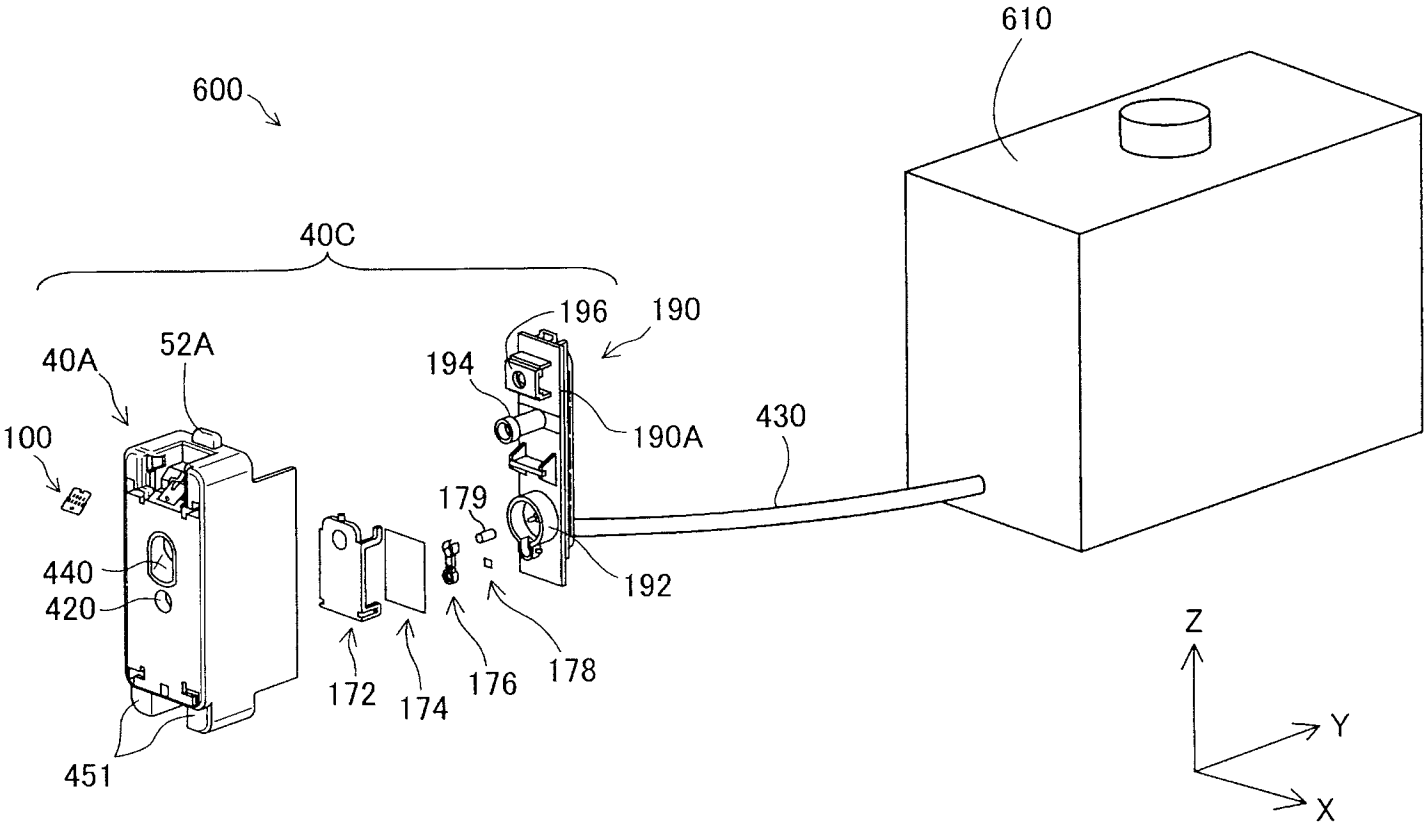
FIG. 32 is a diagram for describing a first modified example.

FIG. 32 is a diagram for describing a first modified example. FIG. 32 illustrates a liquid supply unit 600 which supplies ink to the printer 10. The liquid supply unit 600 is provided with the mounting member 40C, an external liquid retaining body 610 which is arranged outside the printer 10 and the mounting member 40C, and a liquid transporting tube 430 which links the inner portion flow path 199 (FIG. 12) of the mounting member 40C and the external liquid retaining body 610. The external liquid retaining body 610 accommodates the ink which is to be supplied to the printer 10. In the first modified example, only the mounting member 40C is mounted in the mounting section 6. Due to this, regardless of the size of the slot in the mounting section 6, it is possible to retain a large volume of ink in the liquid supply source. In addition, an effect which is similar to the first applied example which is provided with the mounting member 40C is exhibited even in the liquid supply unit 600 of the first modified example. For example, it is possible to suppress a reduction in detection precision of the state of the remaining amount of ink using the moving member 172, the rod-shaped member 92 and the sensor 138.

B-2. Second Modified Example

In the applied example described above, the plurality of sets of regulating sections 4X, 4Y, and 4Z positionally align the attachment member 190 in directions which are different to each other, but the attachment member 190 may be positionally aligned in a direction in which at least a portion of the plurality of sets of regulating sections are different to each other. For example, a cylindrical member which opens to the +Y axis direction side may be arranged in the bottom portion 42 (FIG. 18) in the inner wall of the position alignment member 40A and a portion (protrusion) of the attachment member 190 may be inserted into the inner portion of the cylindrical member. In this case, the cylindrical member is a regulating section which performs positional alignment in the two directions of the X axis direction and the Z axis direction. In addition, in this case, the second regulating section 4Y which performs positional alignment in the Y axis direction may be configured in the same manner as the applied example described above. Even in this case, the same effect as the applied example described above is exhibited.

B-3. Third Modified Example

In the applied example and the modified examples described above, description is performed so that the cartridges 4 and 10*a* which are used in the printer 10 as the liquid container and the mounting member are examples, but without being limited thereto, it is possible to apply the present invention to, for example, a liquid container and a mounting member where it is possible to supply a liquid to a liquid consumption apparatus such as an apparatus which is provided with a coloring material ejecting head for a liquid crystal display or the like, an apparatus which is provided with an electrode material (conductive paste) ejecting head which is used in the forming of electrodes for an organic EL display, a surface-emitting display (FED), or the like, an apparatus which is provided with a bio-organic material ejecting head which is used in bio chip manufacturing, an apparatus which is provided with a sample ejecting head which is a precision pipette, a printing apparatus, or a microdispenser. In addition, without being limited to the ink cartridge, it is possible to apply the present invention to a mounting section in which various types of liquid containers or various types of mounting members are able to be mounted to be freely attached and detached. When the liquid container and the mounting member are used in the various types of liquid consumption apparatuses described above, it is sufficient if the liquid (coloring material, conductive paste, bio-organic material, and the like) is accommodated in a liquid supply source according to the type of liquid which is ejected by the various types of liquid consumption apparatuses. In addition, it is possible to apply the present invention as a liquid consumption system which is provided with various types of liquid consumption apparatuses which are provided with a mounting section and a mounting member corresponding to the various types of liquid consumption apparatuses.

The invention claimed is:

1. A mounting member adapted to be mounted in a liquid consumption apparatus having a liquid consumption apparatus side detection mechanism for detecting a liquid remaining amount inside a liquid supply source, the mounting member comprising:

a position alignment member positionally aligned with respect to the liquid consumption apparatus as the liquid consumption apparatus regulates movement of the position alignment member in three directions, which are orthogonal to each other including a mounting direction in which the mounting member is mounted to the liquid consumption apparatus;

an attachment member attached to the position alignment member such that the attachment member is positionally aligned with respect to a mounting section of the liquid consumption apparatus by the position alignment member, the attachment member including a flow path through which liquid from the liquid supply source is supplied to the liquid consumption apparatus and a liquid chamber that is disposed in a middle of the flow path, with the liquid chamber having an opening part;

a shape changing member attached to the attachment member such that the shape changing member seals the opening part of the liquid chamber to define volume of the liquid chamber that changes according pressure changes inside the liquid chamber; and a moving member attached to the attachment member, and configured and arranged to move in the mounting direction according to pressure changes in the flow path and to contact the liquid consumption apparatus side detection mechanism.

2. The mounting member according to claim 1, wherein an inner wall of the position alignment member includes a plurality of sets of regulating sections, which perform positional alignment of the attachment member in the three directions by abutting against the attachment member, the plurality of sets of regulating sections including two or more sets of regulating sections which perform positional alignment in different directions.

3. The mounting member according to claim 1, wherein a portion of a wall forming a partition of the liquid chamber being formed by the shape changing member which changes shape according to the pressure changes inside the liquid chamber, and the moving member has an attaching section attached to the attachment member with the attaching section forming a fulcrum so that the moving member is displaced in at least the mounting direction, a first contact section contacting the shape changing member from an outside of the liquid chamber, and a second contact section positioned at an opposite side of the fulcrum with respect to the first contact section and contacting the liquid consumption apparatus side detection mechanism.

4. A liquid container comprising:

the mounting member according to claim 1; and the liquid supply source.

5. The liquid container according to claim 4, further comprising a protective member accommodating the liquid supply source;

wherein the protective member is assembled so as to be able to move with respect to the position alignment member.

6. A mounting member adapted to be mounted in a liquid consumption apparatus having a liquid consumption apparatus side detection mechanism for detecting a liquid remaining amount inside a liquid supply source, the mounting member comprising:

a position alignment member positionally aligned with respect to the liquid consumption apparatus as the liquid consumption apparatus regulates movement of the position alignment member in three directions, which are orthogonal to each other including a mounting direction in which the mounting member is mounted to the liquid consumption apparatus;

an attachment member attached to the position alignment member such that the attachment member is positionally aligned with respect to a mounting section of the liquid consumption apparatus by the position alignment member, the attachment member including a flow path through which liquid from the liquid supply source is supplied to the liquid consumption apparatus and a liquid chamber that is disposed in a middle of the flow path, with the liquid chamber having volume that changes according pressure changes inside the liquid chamber; and a moving member attached to the attachment member, and configured and arranged to move in the mounting direction according to pressure changes in the flow path and to contact the liquid consumption apparatus side detection mechanism, an inner wall of the position alignment member including a plurality of sets of regulating sections, which perform positional alignment of the attachment member in the three directions by abutting against the attachment member, the plurality of sets of regulating sections including two or more sets of regulating sections which perform positional alignment in different directions, the position alignment member being a box shape having an opening on one side, when a direction from a bottom portion of the position alignment member to the opening is set as a +Y direction and a direction from the opening to the bottom portion is set as a −Y direction, the plurality of sets of regulating sections having +Y axis abutting sections which regulate movement of the attachment member in the +Y axis direction by abutting against the attachment member and −Y axis abutting sections which regulate movement of the attachment member in the −Y axis direction by abutting against the attachment member, and a number of the +Y axis abutting sections being smaller than a number of the −Y axis abutting sections.

7. A mounting member adapted to be mounted in a liquid consumption apparatus having a liquid consumption apparatus side detection mechanism for detecting a liquid remaining amount inside a liquid supply source, the mounting member comprising:

a position alignment member positionally aligned with respect to the liquid consumption apparatus as the liquid consumption apparatus regulates movement of the position alignment member in three directions, which are orthogonal to each other including a mounting direction in which the mounting member is mounted to the liquid consumption apparatus;

an attachment member attached to the position alignment member such that the attachment member is positionally aligned with respect to a mounting section of the liquid consumption apparatus by the position alignment member, the attachment member including a flow path through which liquid from the liquid supply source is supplied to the liquid consumption apparatus and a liquid chamber that is disposed in a middle of the flow path, with the liquid chamber having volume that changes according pressure changes inside the liquid chamber; and a moving member attached to the attachment member, and configured and arranged to move in the mounting direction according to pressure changes in the flow path and to contact the liquid consumption apparatus side detection mechanism, an inner wall of the position alignment member including a plurality of sets of regulating sections, which perform positional alignment of the attachment member in the three directions by abutting against the attachment member, the plurality of sets of regulating sections including two or more sets of regulating sections which perform positional alignment in different directions, the position alignment member being a box shape having an opening on one side, a direction in which a bottom portion of the position alignment member having the box shape faces the opening extending in a Y direction and two directions which are different to the Y direction among the three directions being set as an X direction and a Z direction, the plurality of sets of regulating sections having a plurality of X direction regulating sections which regulate the movement in the X direction by abutting against the attachment member, the X axis regulating sections being arranged at positions such that at least one of a center line passing through a Y directional center of an abutted member of the attachment member in the Y direction and a center line passing through a Z directional center of the abutted member in the Z direction is interposed between the X axis regulating sections, a plurality of Y direction regulating sections which regulate the movement in the Y direction by abutting against the attachment member, the Y direction regulating sections being arranged at positions such that at least one of the center line passing through the Z directional center of the abutted member in the Z direction and a center line passing through a X directional center of the abutted member in the X direction is interposed between the Y direction regulating sections, and a plurality of Z direction regulating sections which regulate the movement in the Z direction by abutting against the attachment member, the Z direction regulating sections being arranged at positions such that at least one of the center line passing through the X directional center of the abutted member in the X axis direction and the center line passing through the Y directional center of the abutted member in the Y axis direction is interposed between the Z direction regulating sections.

8. A mounting member adapted to be mounted in a liquid consumption apparatus having a liquid consumption apparatus side detection mechanism for detecting a liquid remaining amount inside a liquid supply source, the mounting member comprising:

a position alignment member positionally aligned with respect to the liquid consumption apparatus as the liquid consumption apparatus regulates movement of the position alignment member in three directions, which are orthogonal to each other including a mounting direction in which the mounting member is mounted to the liquid consumption apparatus;

an attachment member attached to the position alignment member such that the attachment member is positionally aligned with respect to a mounting section of the liquid consumption apparatus by the position alignment member, the attachment member including a flow path through which liquid from the liquid supply source is supplied to the liquid consumption apparatus and a liquid chamber that is disposed in a middle of the flow path, with the liquid chamber having volume that changes according pressure changes inside the liquid chamber; and a moving member attached to the attachment member, and configured and arranged to move in the mounting direction according to pressure changes in the flow path and to contact the liquid consumption apparatus side detection mechanism, the position alignment member having an inner wall with first, second and third regulating sections, the first, second and third regulating sections restricting movement of the position alignment member in the three directions, respectively, with each of the first, second and third regulating sections having a plurality of pairs of abutments, and each of the pairs of the abutments contacting against the attachment member in opposite directions along respective one of the three directions, with the pairs of the abutments being spaced away from each other.

* * * * *